US005703621A

United States Patent [19]

Martin et al.

[11] Patent Number: 5,703,621

[45] Date of Patent: Dec. 30, 1997

[54] UNIVERSAL DISPLAY THAT PRESENTS ALL IMAGE TYPES WITH HIGH IMAGE FIDELITY

[75] Inventors: Russel A. Martin, Menlo Park; Richard H. Bruce, Los Altos; Victor M. DaCosta, San Carlos; Thomas G. Fiske, Campbell; Alan G. Lewis, Sunnyvale, all of Calif.; Louis D. Silverstein, Scottsdale, Ariz.; Hugo L. Steemers; Malcolm J. Thompson, both of Palo Alto, Calif.; William D. Turner, San Marino, Calif.

[73] Assignee: Xerox Corporation, Stamford, Conn.

[21] Appl. No.: 679,168

[22] Filed: Jul. 12, 1996

Related U.S. Application Data

[63] Continuation of Ser. No. 235,015, Apr. 28, 1994, abandoned.

[51] Int. Cl.[6] ..... G09G 5/10

[52] U.S. Cl. ..... 345/147; 345/89

[58] Field of Search ..... 345/84, 89, 87, 345/147, 149, 152, 63, 204; 349/33, 41; 257/59, 72, 88, 89; 382/252; 358/456, 455, 457, 458, 459

[56] References Cited

U.S. PATENT DOCUMENTS

| | | | |
|---|---|---|---|
| 4,851,825 | 7/1989 | Naiman | 345/149 |
| 4,921,334 | 5/1990 | Akodes | 345/89 |
| 5,059,963 | 10/1991 | Fukuoka | 345/149 |
| 5,185,602 | 2/1993 | Bassetti, Jr. et al. | 340/793 |
| 5,226,094 | 7/1993 | Eschbach | 382/41 |
| 5,226,096 | 7/1993 | Fan | 382/50 |
| 5,252,959 | 10/1993 | Kono | 345/147 |
| 5,254,982 | 10/1993 | Feigenblatt et al. | 345/148 |
| 5,268,774 | 12/1993 | Eschbach | 358/466 |
| 5,278,678 | 1/1994 | Harrington | 358/518 |
| 5,287,092 | 2/1994 | Shiraishi | 345/137 |
| 5,291,296 | 3/1994 | Hains | 358/298 |
| 5,293,579 | 3/1994 | Stockholm et al. | 382/22 |
| 5,359,342 | 10/1994 | Nakai et al. | 345/89 |
| 5,459,495 | 10/1995 | Scheffer et al. | 345/147 |
| 5,491,347 | 2/1996 | Allen et al. | 257/59 |
| 5,521,989 | 5/1996 | Fan | 382/270 |

FOREIGN PATENT DOCUMENTS

| | | | |
|---|---|---|---|
| 546780A1 | 6/1993 | European Pat. Off. | G09G 3/36 |

OTHER PUBLICATIONS

Bond, J., and Levenson, M.D., "The US gears up to challenge Japan in flat panel displays," *Solid State Technology*, Dec. 1993, pp. 37, 38, and 40–43.

Maeda, H., Fujii, K., Yamagishi, N., Fujita, H., Ishihara, S., Adachi, K., and Takeda, E., "A 15–in.–Diagonal Full–Color High–Resolution TFT–LCD," *SID 92 Digest*, 1992, pp. 47–50.

(List continued on next page.)

*Primary Examiner*—Regina D. Liang

[57] ABSTRACT

An array of light control units has an area large enough to present images for direct viewing. The array also has light control units sufficiently dense that ordinary acuity artifacts are not noticeable in presented images when the array is directly viewed at usual viewing distances by a human with normal vision. Signal circuitry can provide signals to the light control units. The array can present an image that includes M colors, where M is more than three, even though each light control unit can only cause presentation of one of a segment with one of a set of N colors, where N is less than M. Data defining an input image with M colors are used to obtain data defining an output image that is a version of the input image but includes, for each light control unit, a color data item indicating one of its set of N colors. The signal circuitry provides signals to the light control units so that each light control unit presents a segment with the color indicated by its color data item. As a result, the array presents the output image so that its appearance to a human with normal vision viewing the array at usual viewing distances is substantially identical to the appearance the input image would have if presented.

32 Claims, 11 Drawing Sheets

OTHER PUBLICATIONS

Tanaka, Y., Shibusawa, M., Dohjo, M., Tomita, O., Uchikoga, S., and Yamanaka, H., "A 13.8-in.-Diagonal High-Resolution Multicolor TFT-LCD for Workstations" *SID 92 Digest,* 1992, pp. 43-46.

Martin, R., Chuang, T., Steemers, H., Allen, R., Fulks, R., Stuber, S., Lee, D., Young, M., Ho, J., Nguyen, M., Meuli, W., Fiske, T., Bruce, R., Thompson, M., Tilton, M., and Silverstein, L.D., "P-70: A 6.3-Mpixel AMLCD," *SID 93 Digest,* 1993, pp. 704-707.

Kaneko, E., *Liquid Crystal TV Displays: Principles and Applications of Liquid Crystal Displays,* Tokyo, KTK, Scientific, 1987, pp. 212-277.

Sarma, K.R., McCartney, R.I., Heinze, B., Aoki, S., Ugai, Y., Sunata, T., and Inada, T., "A Wide-Viewing-Angle 5-in.-Diagonal AMLCD Using Halftone Grayscale," *SID 91 Digest,* 1991, pp. 555-557.

Silverstein, L.D., Krantz, J.H., Gomer, F.E., Yeh, Y-Y., and Monty, R.W., "Effects of spatial sampling and Luminance quantization on the image quality of color matrix displays," *Journal of the Optical Society of America A,* vol. 7, No. 10, Oct. 1990, pp. 1955-1968.

Gomes, L., "Advanced computer screens have age-old rival," *San Jose Mercury News,* Feb. 21, 1994, pp. 1E and 9E.

Sekular, R., and Blake, R., *Perception,* Second Ed., New York, McGraw-Hill, 1990, pp. 79-88, 148-152, 158-164, and 242-244.

Martin, R., Chuang, T.-C., Steemers, H., Allen, R., Fulks, R., Stuber, S., and Tilton, M., "The Liquid Crystal Laser Print", a 6.3 Million Pixel Monochrome AMLCD, submitted to program committee of Society for Information Display for review on or about Feb. 12, 1993.

Silverstein, L.D., Gomer, F.E., Yeh, Y-Y., and Krantz, J.H., "Empirical Studies of Color Matrix Display Image Quality," *Applied Vision, 1989 Technical Digest Series,* vol. 16, 1989, pp. 152-157.

Lee, D.D., DaCosta, V.M., and Lewis, A.G., "A VLSI Controller for Active-Matrix LCDs," *IEEE International Solid-State Circuits Conference 1994, Digest of Technical Papers,* Feb. 1994, pp. 156-157.

Ulichney, R., *Digital Halftoning,* Cambridge, Mass.: MIT Press, 1987, pp. xiii, xiv, 1-39, 340-344.

Martin, R., Middo, K., Turner, W., Lewis, A., Thompson, M., and Silverstein, L., "A High Resolution AMLCD for the Electronic Library System" *Proceedings of the SPIE,* vol. 2219, SPIE Cockpit Displays Conference, Apr. 7 and 8, 1994, pp. 89-96.

Ruelberg, K.D., and Zander, S., "Colour triple arrangement of liquid crystal displays (LCD)," *Displays,* vol. 14, No. 3, 1993, pp. 166-173.

UNIVERSAL DISPLAY THAT PRESENTS ALL IMAGE TYPES WITH HIGH IMAGE FIDELITY

This is a continuation of application Ser. No. 08/235,015, filed Apr. 28, 1994, now abandoned.

BACKGROUND OF THE INVENTION

The present invention relates to display techniques.

Silverstein, L. D., Krantz, J. H., Gomer, F. E., Yeh, Y-Y., and Monty, R. W., "Effects of spatial sampling and luminance quantization on the image quality of color matrix displays," *Journal of the Optical Society of America A*, Vol. 7, No. 10, October 1990, pp. 1955–1968, describe techniques for simulating images produced by a color matrix display (CMD). Page 1955 describes the quality of a CMD image by the degree to which two distinct types of image artifact, chromatic and spatial distortion, are visually detectable in the image. Chromatic distortion is characterized by color banding, color fringing, and detectable individual primary color elements in mixture colors; such artifacts become perceptible at the point where the human visual system is unable to spatially integrate individual primary-color elements or paterns of elements into an image of the desired color. Spatial distortion is perceived as stairstepping in lines and arcs, jagged edges, and gaps or luminanee bands in primitive graphics and alphanumeric characters; spatial distortion results from the interaction of several imaging parameters, including the resolution or sampling density of the CMD, image-quantization noise produced by individual discrete elements and the geometric pattern or mosaic into which the elements are arranged, truncation errors that are due to a limited number of available gray levels, and the bandwidth requirements of the original graphic image. CMD technology offers the potential for excellent image quality, however, and may ultimately exceed that obtainable with a high-resolution color cathode ray tube (CRT). The simulation techniques and experiments are described beginning at page 1956. Page 1957 describes three types of test images used in the experiments, selected to represent a minimum set of primitive graphical features with high sensitivity to spatial and chromatic distortions.

SUMMARY OF THE INVENTION

The invention is based on the discovery of a new technique for presenting images. The new technique can present all image types—including but not limited to graphical, text, gray-scale, natural, and video images—on the same display with high image fidelity. The new technique can present different types of images concurrently in arbitrarily selected parts of the display; it can present different types of images in sequence over the entire display area; and it can combine concurrent and sequential presentation of different types of images.

The new technique can use the same display hardware for all image types, accommodating the specific requirements of different types of images by processing data defining images appropriately before presenting the images on the display. In addition to the new technique that presents all types of images with high fidelity, the invention provides other advantages that arise from the structure of the display and the techniques that produce it.

Conventional displays for direct viewing-including cathode ray tubes (CRTs), liquid crystal displays (LCDs), and plasma displays—have relatively low densities of light control units, often referred to as "cells," "pixels," or "subpixels." The light control units in a conventional display have low densities because the size of light control units is relatively large, and light control unit density is the inverse of the size of light control units. The large size of light control units also limits the number of light control units per unit of viewing. angle at usual viewing distances. Even though a conventional display may have about 300,000 light control units, as in an ordinary computer display, or about one million light control units, as in a high resolution display, a human with normal vision can notice shapes of light control units at usual viewing distances in many images.

In conventional displays, each light control unit responds to a drive signal by controlling the color of an image segment. Typically, each light control unit can present one of a set of colors of the same hue but varying across a range of intensity. To present monochrome gray scale images, all of the light control units can present colors from the same set. To present color images, different light control units can present non-gray colors from different sets.

Although many natural and gray scale images can be presented acceptably using the conventional displays described above, small details in an image may be lost due to the resolution limit that results from the large size of each light control unit. More significantly, fine lines in a graphical or text image are inevitably broadened due to the large size of each light control unit, limiting the amount of information presented: For example, details of text fonts cannot be reproduced, and small fonts are unreadable, reducing the number of words that can be read. Similarly, the level of detail that can be presented in a map or other information-rich image is limited. Further, artifacts of spatial sampling are noticeable, such as jaggies on diagonal lines. In short, conventional displays show less information than a typical printed image, which is not subject to the resolution limit due to light control unit size.

In addition, technology-specific problems can affect certain display technologies, such as those that use liquid crystal material. LCDs are advantageous for portable applications because of their light weight and flatness. But conventional LCDs typically present images of limited quality for several reasons in addition to the large size of light control units: LCDs typically have relatively few gray levels, and therefore cannot present other levels of gray accurately. As a result, a gray scale image presented by an LCD is likely to have noticeable steps or contours between gray levels. LCDs also have limited viewing angle when presenting intermediate gray levels. The liquid crystal transfer curve also tends to be strongly temperature dependent, and costly temperature correction circuitry is needed to maintain a fixed gray level at different temperatures. The new technique alleviates the problem of large light control units that affects all conventional display technologies. The new technique can also alleviate technology-specific problems.

The new technique presents images using an array of light control units. The array has an area large enough to present images for direct viewing. The light control units are sufficiently dense that ordinary acuity artifacts are not noticeable in presented images when the array is directly viewed at usual viewing distances by a human with normal vision. Because the artifacts are not noticeable, they do not detract from image quality, making it possible to provide image quality approaching that available in a printed image. Further, if a printed version of an image would include artifacts of printing, the array may present the image with higher fidelity than the printed version.

As used herein, an "ordinary acuity artifact" is an artifact that results from presenting an image in segments and that is visible only up to spatial frequencies of approximately 60 cycles per degree of visual angle. Examples include boundaries between scan lines, jagged edges, and other features that indicate an edge between segments presented by different light control units. Artifacts that are visible to significantly greater spatial frequencies than 60 cycles per degree are referred to herein as "hyperacuity artifacts."

The new technique starts with an input image that includes M colors, where M is three or more, and uses the input image to obtain an output image that is a version of the input image. The new technique provides the output image to a display that includes a dense array of light control units as described above. Each light control unit can present an image segment with one of a set of N colors, where N is less than M. Nevertheless, the array presents the output image so that the appearance of the output image to a human with normal vision directly viewing the array at usual viewing distances is substantially identical to the appearance the input image would have if presented.

In relation to an image defined by data, the appearance the image "would have if presented" means the visual perception that would be produced in a human with normal vision viewing, at usual viewing distances, a presentation of the image by an image output device capable of accurately presenting every detail indicated by the data defining the image, including all colors, shapes, edges, and other features in the image. Such a presentation could be called a "full fidelity" presentation since it is completely faithful to the image as defined by the data.

It is known that the ability of humans to distinguish regions of different intensity in an image decreases as the spatial frequency of the associated variations increases. For example if alternate light control units in a display present segments at different gray levels, then in order for a viewer to discern that two distinct gray levels are present (instead of a uniform region of an intermediate gray level), the intensity difference between the gray levels must increase as the size of light control units decreases. Ultimately, if the size of light control units is small enough, then the viewer is unable to distinguish an image with alternate light control units presenting maximum and minimum intensity and all light control units presenting mid-gray.

The new technique exploits the fact that the number of gray levels each light control unit presents can be reduced as the density of light control units increases without diminishing the perceived quality of gray scale images presented on the display for the reason indicated above. At very high densities, the number of gray levels can be reduced to two and the display becomes binary. While reducing the number of available gray levels does not reduce perceived image quality, it does offer significant advantages. In particular, the ability accurately to present detailed graphical images (such as maps or technical plans) or dense text images is enhanced by an increased density of light control units. The display system is also simplified and the likelihood of the display device failing due to defects arising during manufacturing is reduced. It thus becomes possible to build displays with higher densities of light control units than could be achieved if the gray scale resolution were kept constant. These and other advantages of the invention are discussed further below.

The use of a high density display with a gray scale resolution matched to the limits of the human visual system also means that different techniques must be used in order to present images with the highest possible perceived quality. In particular, gray levels other than those which are actually available on the display may be presented using a dithering technique; several such techniques are known, and different techniques may be better suited to differing image types (static or moving gray scale images for example). Non-gray scale (binary) images, such as graphical line drawings or text, which contain only features of maximum or minimum intensity, will in general require no processing prior to presentation on the display. The display system may thus distinguish (either automatically or under the control of a user) different types of image, or different regions of the same image, and can obtain data defining a version of each image in the most appropriate manner. Alternatively, if a system is dedicated to a specific function, such as the reproduction of video images, then it may be permanently configured to perform one specific type of image processing.

The new technique can be implemented in a product that includes image input circuitry and a display with a dense array as described above. The image input circuitry receives input image data defining an input image that includes M colors. The technique uses the input image data to obtain output image data defining an output image that is a version of the input image. The output image data includes, for each light control unit in the array, a color data item that indicates one of the light control unit's set of N colors. The technique provides the output image data to signal circuitry in the display. The signal circuitry responds by providing signals to the light control units so that each light control unit presents an image segment with the color indicated by the light control unit's color data item. As a result, the light control units in the array together present the output image so that its appearance is substantially identical to the appearance the input image would have if presented.

The array could be of any size large enough for direct viewing of images, but one working implementation has an area of approximately 510 $cm^2$. To ensure that ordinary acuity artifacts are not visible, the light control units in the array can have a density that exceeds 100/cm in each direction, so that the total number of light control units in an array of 90 $cm^2$ would exceed 900,000, and an 18 cm by 24 cm array with an area of 432 $cm^2$ would include at least 4.32 million light control units. The working implementation of 510 $cm^2$ has densities of 111/cm in both directions, so that it includes approximately 6.3 million light control units.

Each light control unit's set of colors can include two colors, one with its maximum intensity and the other with its minimum intensity. For example, each light control unit can have two states in which it is driven, one in which it is fully saturated in an ON state and the other in which it is fully saturated in an OFF state. As a result, intermediate gray levels are unnecessary, and the light control unit's design can be simpler with operating requirements that are easier to achieve.

The display can include, for example, an active matrix liquid crystal display (AMLCD) that includes the array of light control units. In an AMLCD, high quality gray scale images normally require voltage control for each light control unit to within a few tens of millivolts. But if the light control unit is only driven in its fully ON and fully OFF saturation states, the voltage can vary by more than a volt without any impact on display performance.

Similarly, temperature correction is not needed since the exact voltage range over which the ON to OFF transition occurs does not matter.

The new technique is also advantageous with displays other than AMLCDs, because it presents high quality images. For example, the technique can present a line drawing with very fine line widths, a text as readable as on a printed page, and a multi-color image such as a natural or gray scale image with fine detail and with a wide range of colors. Display of such images with conventional techniques would produce ordinary acuity artifacts such as jaggies.

A product implementing the invention can also include processing circuitry connected for receiving data defining input images from the image input circuitry and for providing data defining output images to the signal circuitry of the display. The processing circuitry can include memory for storing data and a processor connected for accessing data in the memory. The stored data can include instruction data the processor can execute. In executing the instructions, the processor can use the input image data to obtain the output image data by performing dithering.

In presenting a binary monochrome input image-i.e. an image for which each segment is either black or white such as a line drawing or a text image—the new technique can map a feature in the input image directly onto a set of light control units in the array. For example, to render a black line on a white background where the line has a width of one light control unit, the technique can drive each light control unit in a row at its minimum intensity, while surrounding light control units are driven at maximum intensity. Similarly, black characters in different fonts can be presented by driving appropriate sets of light control units at their minimum intensity, with surrounding light control units at maximum intensity.

In presenting a multi-color input image that includes pixels, such as a natural image or a gray scale image, the technique can convert a pixel's value to an approximation in which a set of light control units are driven, some at maximum intensity and some at minimum intensity. For example, the new technique can perform spatial dithering, such as error diffusion, half toning, or blue noise masking. As a result of the small size of each light control unit, a human perceives the set of light control units as presenting the color of the pixel from the input image. The technique can also perform temporal dithering, such as by varying the duty cycles of light control units to obtain intermediate colors, and can combine temporal and spatial dithering in presenting an image.

The new technique makes it possible to present static images with the same fidelity available with conventional printing techniques. In addition, the new technique can be implemented with a display that can be updated at video rates of 24 times per second or more, making it possible to present a video sequence of images with the same high quality.

The new technique described above is advantageous compared to conventional techniques because it can be used to present a wide range of different images for direct viewing without noticeable ordinary acuity artifacts, preserving fine lines in line drawings, character edges in text, and fine detail and a full range of colors in a multi-color images such as natural and gray scale images. In addition, when implemented in an AMLCD, the new technique can provide improved viewing angle due to exceptional off axis performance and a brighter image.

The new technique is also advantageous because it reduces the number of distinct colors presented by each light control unit. Conventional AMLCDs drive light control units to intermediate levels, while the new technique can drive each light control unit to a saturation state, making it more tolerant of temperature instabilities and imprecise drive voltages. At the same time, because each light control unit need only be driven at a small number of saturation states, the circuitry can be simple. Further, because it uses a dense array of light control units, the new technique provides higher fidelity versions of input images than would be available with additional levels of gray in a gray scale image or with additional colors in a full color image: Humans with normal vision would not perceive the additional gray levels or colors anyway, but humans with normal vision can easily see that the new technique provides higher fidelity for binary images such as line drawings and text.

The following description, the drawings, and the claims further set forth these and other aspects, objects, features, and advantages of the invention.

DETAILED DESCRIPTION

A. Conceptual Framework

Figure 1:
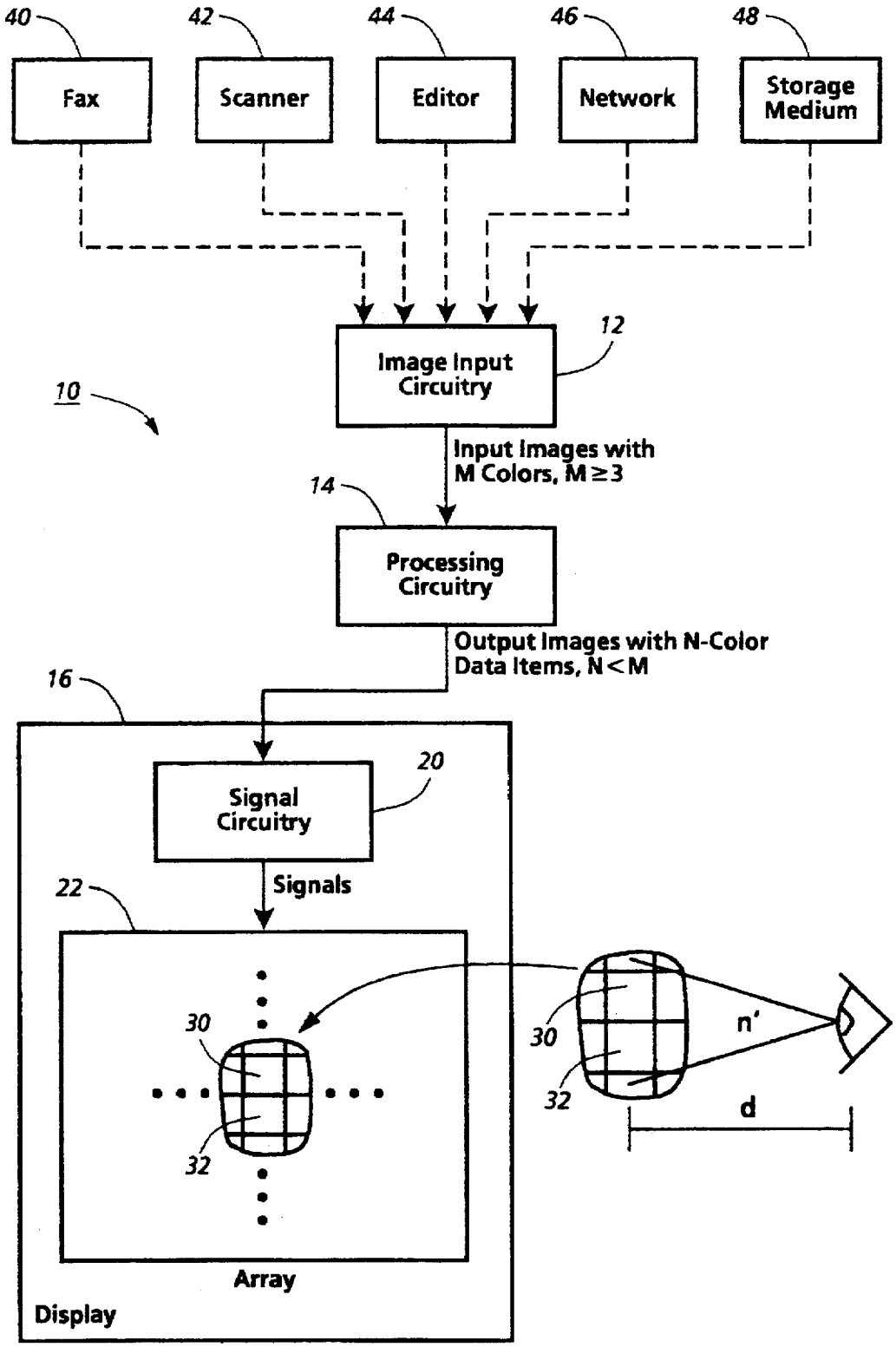
FIG. 1 is a schematic block diagram showing general components of a product in which processing circuitry uses data defining an image with M colors to present the image without ordinary acuity artifacts on a directly viewed array of light control units, each of which can present N colors, where N is less than M.

The following conceptual framework is helpful in understanding the broad scope of the invention, and the terms defined below have the indicated meanings throughout this application, including the claims.

The term "data" refers herein to physical signals that indicate or include information. When an item of data can indicate one of a number of possible alternatives, the item of data has one of a number of "values." For example, a binary item of data, also referred to as a "bit," has one of two values, interchangeably referred to as "1" and "0" or "ON" and "OFF" or "high" and "low." A bit is an "inverse" of another bit if the two bits have different values. An N-bit item of data has one of $2^N$ values.

The term "data" includes data existing in any physical form, and includes data that are transitory or are being stored or transmitted. For example, data could exist as electromagnetic or other transmitted signals or as signals stored in electronic, magnetic, or other form.

"Circuitry" or a "circuit" is any physical arrangement of matter that can respond to a first signal at one location or time by providing a second signal at another location or time, where the second signal includes information from the first signal. Circuitry "stores" a first signal when it receives the first signal at one time and, in response, provides the second signal at another time. Circuitry "transfers" a first signal when it receives the first signal at a first location and, in response, provides the second signal at a second location.

A signal "indicates" or "selects" one of a set of alternatives if the signal causes the indicated one of the set of alternatives to occur.

Any two components are "connected" when there is a combination of circuitry that can transfer signals from one of the components to the other. For example, two components are "connected" by any combination of connections between them that permits transfer of signals from one of the components to the other. Two components are "electrically connected" when there is a combination of circuitry that can transfer electric signals from one to the other.

A "data storage medium" or "storage medium" is a physical medium that can store data. Examples of data storage media include magnetic media such as diskettes, floppy disks, and tape; optical media such as laser disks and CD-ROMs; and semiconductor media such as semiconductor ROMs and RAMs. As used herein, "storage medium" covers one or more distinct units of a medium that together store a body of data. For example, a set of floppy disks storing a single body of data would together be a storage medium. "Memory circuitry" or "memory" is any circuitry that can store data, and may include local and remote memory and input/output devices. Examples include semiconductor ROMs, RAMs, and storage medium access devices with data storage media that they can access.

A "data processing system" is a physical system that processes data. A "data processor" or "processor" or "processing circuitry" is any component, system, or circuitry that can process data, and may include one or more central processing units or other processing components. A processor performs an operation or a function "automatically" when it performs the operation or function independent of concurrent human control.

A processor "accesses" an item of data in memory by any operation that retrieves or modifies the item, such as by reading or writing a location in memory that includes the item. A processor can be "connected for accessing" an item of data by any combination of connections with local or remote memory or input/output devices that permits the processor to access the item.

A processor or other component of circuitry "operates on" an item of data by performing an operation that includes obtaining a resulting item of data that depends on the item of data operated on. For example, the resulting item of data could result from an operation that accesses the item of data operated on or from a logic or arithmetic operation on the item of data operated on.

A processor or other component of circuitry "uses" an item of data in performing an operation when the result of the operation depends on the value of the item. For example, the operation could perform a logic or arithmetic operation on the item or could use the item to access another item of data.

An "instruction" is an item of data that a processor can use to determine its own operation. A processor "executes" a set of instructions when it uses the instructions to determine its operations. Execution of instructions "causes" a processor to perform an operation when the processor performs the operation in the process of executing the instructions.

To "obtain" or "produce" an item of data is to perform any combination of operations that begins without the item of data and that results in the item of data. An item of data can be "obtained" or "produced" by any operations that result in the item of data. An item of data can be "obtained from" or "produced from" other items of data by operations that obtain or produce the item of data using the other items of data.

An item of data "indicates" a thing, an event, or a characteristic when the item has a value that depends on the existence or occurrence of the thing, event, or characteristic or on a measure of the thing, event, or characteristic.

An operation or event "transfers" an item of data from a first component to a second if the result of the operation or event is that an item of data in the second component is the same as an item of data that was in the first component prior to the operation or event. The first component "provides" the data, and the second component "receives" or "obtains" the data.

An "array of data" or "data array" or "array" is a combination of items of data that can be mapped into an array. A "two-dimensional array" is a data array whose items of data can be mapped into an array having two dimensions.

An item of data "defines" an array when it includes information sufficient to obtain or produce the array. For example, an item of data defining an array may include the defined array itself, a compressed or encoded form of the defined array, a pointer to the defined array, a pointer to a part of another array from which the defined array can be obtained, or pointers to a set of smaller arrays from which the defined array can be obtained.

An "image" is a pattern of physical light.

When an image is a pattern of physical light in the visible portion of the electromagnetic spectrum, the image can produce human perceptions. The term "graphical feature", or "feature", refers to any human perception produced by, or that could be produced by, an image.

An image "shows" a feature when the image produces, or could produce, a perception of the feature.

An image may be divided into "segments," each of which is itself an image. A segment of an image may be of any size up to and including the whole image.

An item of data "defines" an image when the item of data includes sufficient information to produce the image. For example, a two-dimensional array can define all or any part of an image, with each item of data in the array providing a value indicating the color of a respective location of the image.

A "version" of a first image is a second image produced using an item of data defining the first image and that includes information from the first image. The second image may be identical to the first image, or it may be modified by changing the data defining the first image or by other processes that result in a modified version.

A "pixel" is the smallest segment of an image whose value is indicated in an item of data defining the image. In an array defining an image in which each item of data provides a value, each value indicating the color of a location may be called a "pixel value." Each pixel value is a bit in a "binary form" of an image, a gray scale value in a "gray scale form" of an image, or a set of color space coordinates in a "color coordinate form" of an image, the binary form, gray scale form, and color coordinate form each being a two-dimensional array defining an image.

An item of data indicates "M colors" when the item of data indicates, for each of M different colors, that at least one part of an image has the color. For example, the item of data can indicate, for each segment in the image, one of the M colors. An item of data defines an image that "includes M colors" if the item of data defines the image and indicates M colors.

"Image input circuitry" is circuitry for obtaining data defining images as input.

Image input circuitry is "able to provide data indicating M colors" if the image input circuitry can obtain and provide items of data that define images that include M colors.

An "image input device" is a device that can receive an image and provide an item of data defining a version of the image. A "scanner" is an image input device that receives an image by a scanning operation, such as by scanning a document.

"Image output circuitry" is circuitry for providing data defining images as output.

An "image output device" is a device that can provide output defining an image.

"Display circuitry" is circuitry that can receive data defining a sequence of images and present versions of the images in sequence so that a viewer can perceive the versions of the images in sequence. A "display" is an image output device that includes display circuitry. Display circuitry or a display may, for example, include a cathode ray tube; an array of light emitting, reflecting, or absorbing elements; a structure that presents sequences of images on a screen, paper, or another medium; or any other structure capable of presenting sequences of images in response to data that define them. To "present an image" on display circuitry or a display is to operate the display circuitry or display so that a viewer can perceive the image.

A "light control unit" is a part of display circuitry that is structured to receive a signal and to respond to its signal by causing presentation of an image segment with one of a set of colors.

"Signal circuitry" is circuitry for providing signals to light control units in response to data defining output images.

A light control unit responds to a signal "by causing presentation of a segment" or "by presenting a segment" if the signal determines how the light control unit presents the segment. For example, the signal can have a number of levels, with each level causing the light control unit to present the segment with a color for the level.

An "array of light control units" includes light control units arranged to present images. An array of light control units can, for example, extend in first and second directions that are perpendicular.

A "density" of light control units in a direction is an average number of the light control units per unit of extent in the direction. For example, a density of 100/cm means that, on average, each centimeter includes 100 pixel units.

The "area" of an array of light control units that extends in first and second directions is the product of the array's extent in the first direction and its extent in the second direction. For example, an array the size of an index card that measures 7.5 cm×12.5 cm is 93.75 $cm^2$.

A "liquid crystal cell" is an enclosure containing a liquid crystal material.

A "liquid crystal display" or "LCD" is a display that includes a liquid crystal cell with a light transmission characteristic that can be controlled in parts of the cell by an array of light control units to cause presentation of an image. An "active matrix liquid crystal display" or "AMLCD" is a liquid crystal display in which each light control unit has a nonlinear switching element that causes presentation of an image segment by controlling a light transmission characteristic of an adjacent part of the liquid crystal cell.

A "saturation state" of a light control unit is a state in which it is driven fully ON or fully OFF such that .slight changes in its signal do not change the intensity of light it presents.

In a version of an image presented by an array of light control units, an "artifact" is a feature of the version that is not in the image but that is visible due to a boundary between segments presented by adjacent light control units. Artifacts typically result from sampling that is inherent in presenting an image as an array of image segments. An "ordinary acuity artifact" is an artifact that is visible only up to spatial frequencies of approximately 60 cycles per degree of visual angle. Examples include boundaries between scan lines, jagged edges, and other features that indicate a boundary between segments presented by different light control units. Artifacts that are visible to significantly greater spatial frequencies than 60 cycles per degree of visual angle are referred to herein as "hyperacuity artifacts"; an example of a hyperacuity artifact is an offset in a line one light control unit wide.

The "appearance" of an image presented by an image output device is the visual perception produced by the presentation.

A "usual viewing distance" at which an array of light control units is viewed is a distance at which a human would ordinarily view the array. For example, the usual viewing distance of a computer display is typically between 40–60 cm.

A "human with normal vision" is a human whose vision meets an appropriate criterion for normalcy. For example, the criterion could require 20/20 equivalent or better corrected visual acuity, normal vertical and lateral phoria, normal stereopsis, and normal color vision.

Where an image is defined by data, the appearance the image "would have if presented" is the visual perception that would be produced in a human with normal vision viewing, at usual viewing distances, a presentation of the image by an image output device capable of accurately presenting every detail indicated by the data defining the image, including all colors, shapes, edges, and other features in the image. Such a presentation could be called a "full fidelity" presentation since it is completely faithful to the image as defined by the data.

A human "directly views" an image if the human views the image without an optical aid such as a magnifying lens, a microscope, glasses, contact lenses, binoculars, or a telescope.

An array has an area that is "large enough to present images for direct viewing" if the area of the array is large enough that it can present images that are perceptible as images to a human with normal vision directly viewing the array at usual viewing distances.

Light control units are arranged within an array "so that ordinary acuity artifacts are not noticeable in presented images when the array is directly viewed at usual viewing distances by a human with normal vision" if the manner in which the light control units are arranged ensures that ordinary acuity artifacts will not be noticed in typical images by a human with normal vision directly viewing the array at usual viewing distances. For example, light control units arranged at a uniform density greater than 120 per degree of visual angle can meet this criterion. The criterion can be met even if it might be possible to see ordinary acuity artifacts—barely perceptible artifacts are not noticeable in typical images and therefore do not detract from image quality.

The appearance of a presented image is "substantially identical to" the appearance an image defined by data would have if presented if most humans with normal vision viewing in sequence, at usual viewing distances, the presented image and a full fidelity presentation of the image defined by data would conclude that the two were the same image.

An operation performs "dithering" if the operation uses a first data item that defines a first image that includes M colors, where M is three or more, to obtain a second data item defining a second image that is a version of the first image, where the second data item includes, for each segment of the second image, a color data item that indicates one of a set of N colors, where N is less than M. Dithering thus obtains data defining a second image that can be presented with less colors than the first image. If the second image is presented at an appropriate resolution, it can be perceptible as substantially identical to the first image.

An operation performs "spatial dithering" if the color data items for a set of two or more segments of the second image indicate a combination of colors in the set of N colors that can together produce a perception of one of the M colors in the first image that is not in the set of N colors. An operation performs "temporal dithering" if the color data item of one of the segments of the second image indicates a temporal relationship between time periods during which the segment is presented with each of a subset of the N colors such that the segment can produce a perception of one of the M colors in the first image that is not in the set of N colors; the color data item could, for example, indicate a relationship between duty cycles of colors. An operation can thus perform temporal dithering and spatial dithering at the same time.

A "gray color" is a color between white and black; the perception of a gray color can be produced by a spatially dithered image that includes only white pixels and black pixels. A "non-gray color" is a color other than white, black, and gray.

B. General Features

Figure 2:
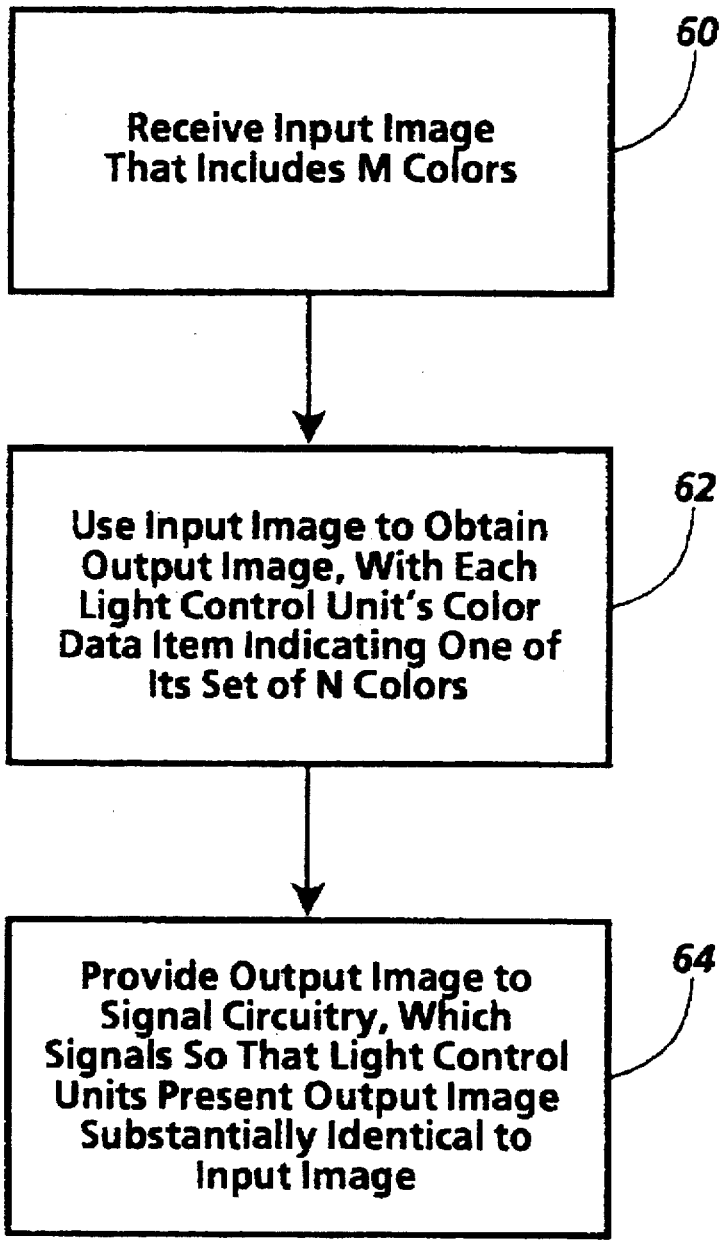
FIG. 2 is a flow chart showing general acts in using a product like that in FIG. 1.

FIGS. 1 and 2 show general features of the invention. FIG. 1 shows general components of a product with processing circuitry that uses data defining an image with M colors to present the image without noticeable ordinary acuity artifacts on a directly viewed array of light control units, each of which can present N colors, where N is less than M. FIG. 2 shows general acts in using the product of FIG. 1.

In FIG. 1, product 10 includes input image circuitry 12, processing circuitry 14, and display circuitry 16. Display circuitry 16 includes signal circuitry 20 and array 22 of light control units. Array 22 has an area large enough to present images for direct viewing, and illustratively includes light control units 30 and 32.

FIG. 1 also shows illustrative light control units 30 and 32 arranged so that two segments of an image being presented are smaller than n minutes of visual angle at usual viewing distance d. If n=2, ordinary acuity artifacts may be just barely visible but are not noticeable in typical presented images when array 22 is directly viewed at usual viewing distance d by a human with normal vision. If n=1, ordinary acuity artifacts are not visible.

Processing circuitry 14 is connected for receiving data defining input images from image input circuitry 12 and for providing data defining output images to signal circuitry 20. As shown, image input circuitry 12 is able to provide data indicating M colors, where M is three or more. Each light control unit in array 22, however, is structured to receive a signal and to respond to its signal by causing presentation of an image segment with one of a set of N colors, where N is less than M. Therefore, processing circuitry 14 provides data to signal circuitry 20 in which a color data item for each light control unit indicates one of the light control unit's set of N colors.

FIG. 1 also shows that image input circuitry 12 in product 10 could receive data defining images from a number of sources, including but not limited to facsimile (fax) machine 40; scanner 42; editor 44, which could be an interactive image editor controlled by user input devices such as a keyboard and mouse or a pen- or stylus-based input device; from network 46, which could be a local area network or other network capable of transmitting data defining an image; or from storage medium 48, which could be any storage medium capable of storing data defining images, and could be accessible through an appropriate storage medium access device connected to image input circuitry 12. As suggested by the dashed lines connecting these components to image input circuitry 12, each of these components could be a part of product 10 or could instead be an external component that can be connected to product 10.

FIG. 2 shows general acts in using product 10 in FIG. 1.

In the act in box 60, processing circuitry 14 receives a data item defining an input image from image input circuitry 12. The input image defined by the data item includes M colors, where M is greater than 3.

In the act in box 62, processing circuitry 14 uses the input image data item from box 60 to obtain an output image data item defining an output image that is a version of the input image. The output image data item from box 62 includes, for each light control unit in array 22, a color data item that indicates one of the light control unit's set of N colors.

In the act in box 64, processor 14 provides the output image data item from box 62 to signal circuitry 20. Signal circuitry 20 responds by providing signals to the light control units in array 22 so that each light control unit presents an image segment with the color indicated by the light control unit's color data item. Therefore, the array of light control units together present the output image so that the appearance of the output image to a human with normal vision directly viewing the array at usual viewing distances is substantially identical to the appearance the input image would have if presented.

C. Implementation

The general features described above could be implemented in numerous ways on various machines to present images in which ordinary acuity artifacts are not noticeable. As described below, the general features have been implemented for both monochrome and color presentation of images. The implementation described below is also described in Martin, R., Chuang, T., Steemers, H., Allen, R., Fulks, R., Stuber, S., Lee, D., Young, M., Ho, J., Nguyen, M., Meuli, W., Fiske, T., Bruce, R., Thompson, M., Tilton, M., and Silverstein, L. D., "P-70: A 6.3-Mpixel AMLCD," SID 93 *Digest*, 1993, pp. 704–707.

C.1. Fidelity and Artifacts

Figure 3:
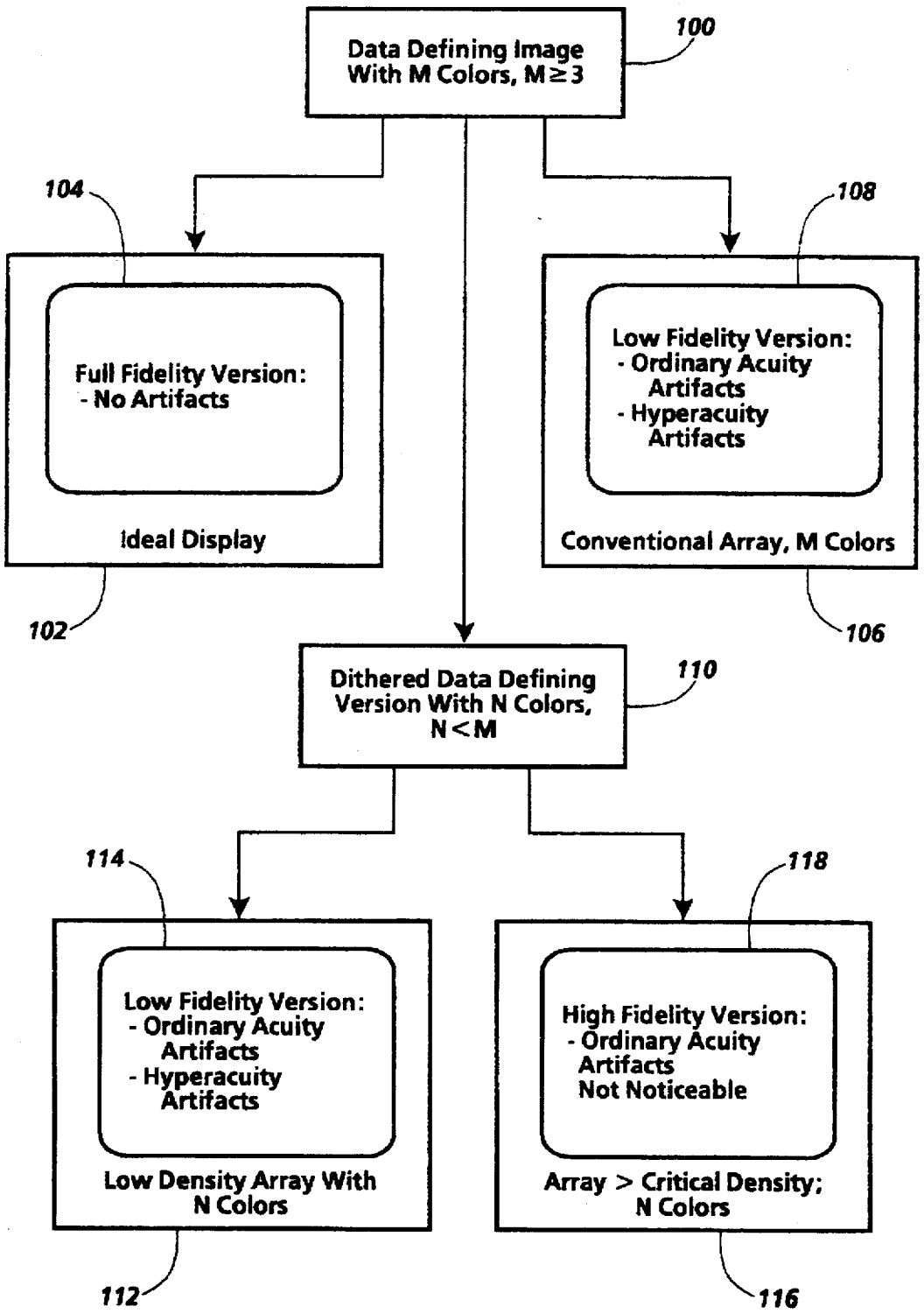
FIG. 3 is a schematic flow diagram illustrating how a high fidelity version of an image can be presented without ordinary acuity artifacts.

FIG. 3 illustrates graphically how different displays can present an image differently. The image being displayed is defined by data item 100, which defines the image with M colors, where M is greater than 3.

Ideal display 102 is an imaginary display capable of presenting any image perfectly. Therefore, ideal display 102 is able to present the image defined by data item 100 with full fidelity. The full fidelity presentation of the image does not include any artifacts that would result from the process of presenting the image on a non-ideal display.

FIG. 3 also shows three possible ways of presenting the image defined by data item 100 with less than full fidelity.

One way employs conventional display 106 with an array of light control units, each of which is able to present M colors. The light control units have a density sufficiently low, however, that display 106 presents a low fidelity version 108 of an image. Version 108 includes at least two kinds of artifacts resulting from the process of presenting the image on display 106. One type of artifact includes ordinary acuity artifacts, meaning artifacts that are visible only up to spatial frequencies of approximately 60 cycles per degree of visual angle. Examples include such familiar artifacts as boundaries between scan lines, jagged edges, and other features that indicate an edge between segments. Another type of artifact includes hyperacuity artifacts, which are visible even at spatial frequencies significantly greater than 60 cycles per degree. One familiar example is an offset of one unit in a line that is one light control unit wide.

The other two ways employ displays that include arrays of light control units, each of which is able to present a set of N colors, where N is less than M. Therefore, both ways begin by obtaining dithered data item 110 defining a version of the image with color data items, each indicating one of N colors.

Display 112 includes an array of light control units of approximately the same density as display 106 and therefore responds to dithered data item 110 by presenting low fidelity version 114 of the image. Low fidelity version 114 includes the same two kinds of artifacts resulting from the process of presenting the image on display 106, ordinary acuity and hyperacuity artifacts. In addition, low fidelity version 114 includes dithering artifacts resulting from dithering operations, such as patterns of light control units. Therefore, low fidelity version 114 is lower in quality than low fidelity version 108.

Display 116, on the other hand, includes a dense array of light control units, sufficiently dense that it is above the critical density at which ordinary acuity artifacts become unnoticeable to humans with normal vision directly viewing the array at usual viewing distances. Therefore, display 116 is able to present high fidelity version 118 of the image in which ordinary acuity artifacts and dithering artifacts are not noticeable when the array is directly viewed at usual viewing distances by a human with normal vision. High fidelity version 118 may, however, include hyperacuity artifacts, which are perceptible up to a much higher critical density.

C.3. General Implementation

Figure 4:
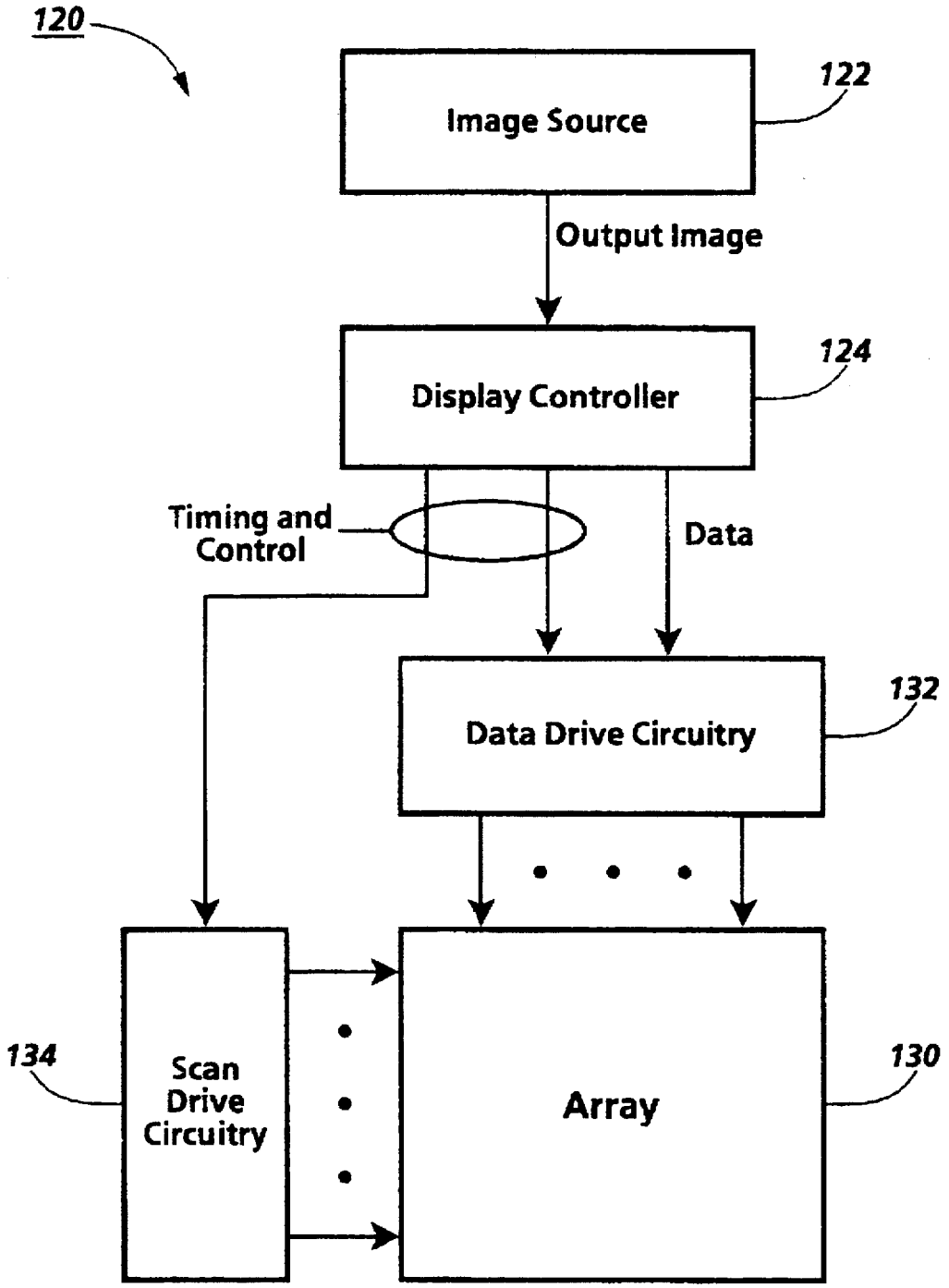
FIG. 4 is a schematic block diagram showing general components of a product that can present high fidelity versions of images without ordinary acuity artifacts.
Figure 5:
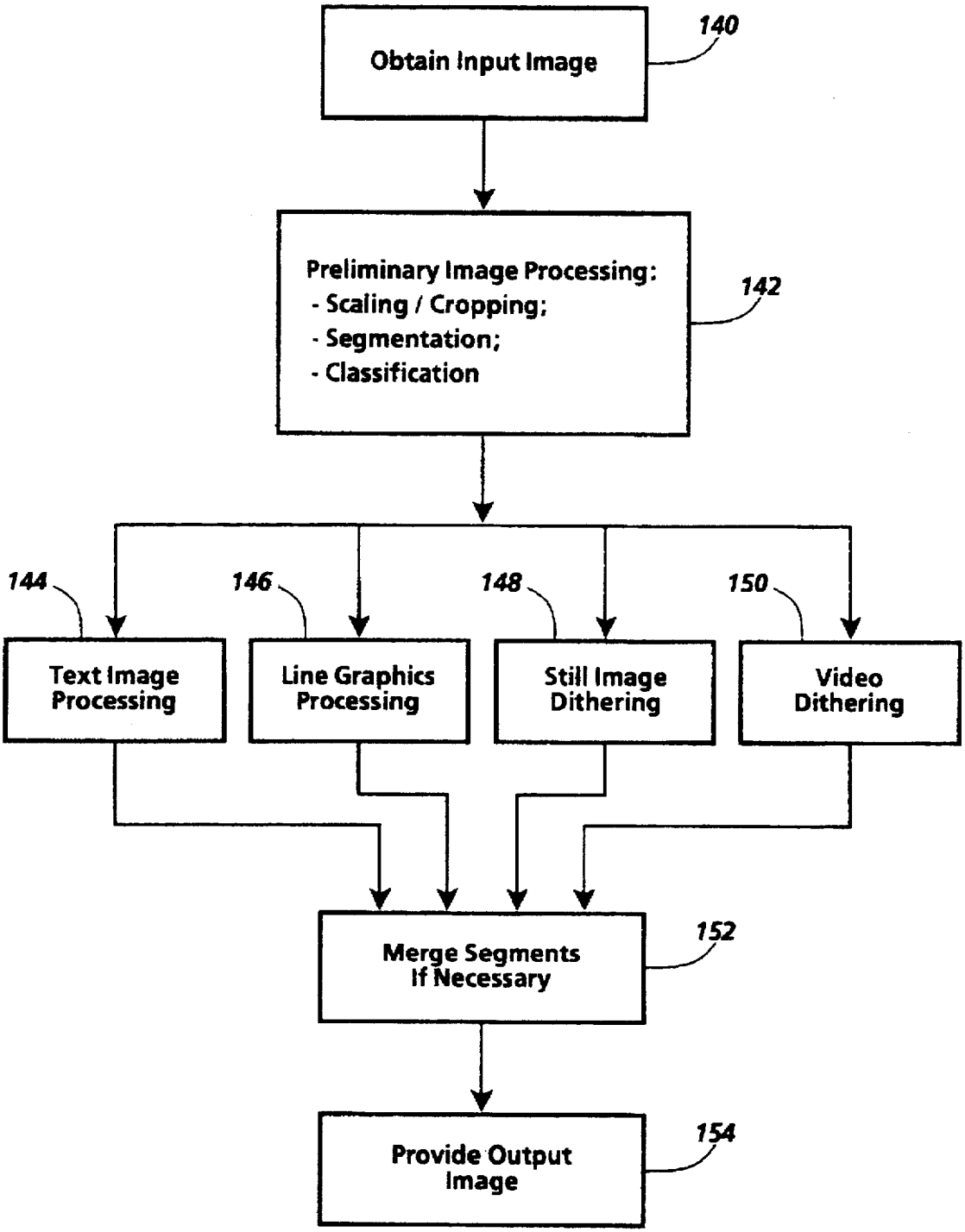
FIG. 5 is a flow chart showing general acts in obtaining data defining a version of an input image for presentation by the product of FIG. 4.

FIG. 4 shows general components of a product in which features described in relation to FIGS. 1 and 2 can be implemented. FIG. 5 shows general acts in obtaining data defining a version of an input image appropriate for presentation by the product of FIG. 4.

Product 120 in FIG. 4 includes image source 122, which can be any workstation, personal computer, microprocessor, or other data processing system capable of using input image data defining an input image to obtain output image data defining a version of the input image appropriate for presentation by product 120. Image source 122 provides the output image data to display controller 124 through an appropriate high bandwidth connection such as an internal system bus. Image source 122 and display controller 124 can also exchange appropriate timing and control signals (not shown).

Display controller 124 responds to output image data from image source 122 by providing appropriate signals so that array 130 presents the version of the input image defined by the output image data. In doing so, display controller 124 performs any format changes or conversions necessary for the connection to data drive circuitry 132. Display controller 124 also provides timing and control signals to both data drive circuitry 132 and scan drive circuitry 134.

The act in box 140 in FIG. 5 begins by obtaining data defining an input image. The act in box 140 can obtain the input image data in a standard format or can convert it to a standard format as appropriate for subsequent operations.

The act in box 142 uses the input image data from box 140 to perform preliminary image processing, which can include any necessary scaling and cropping, segmentation of the input image, classification of the input image or of its segments, and determination of an appropriate dithering operation. Based on the results from box 142, the input image can be dithered in any appropriate way, several of which are shown in FIG. 5.

The act in box 144 performs operations appropriate for an image or segment that shows text. The act in box 146 performs operations appropriate for line graphics. The acts in boxes 144 and 146 can each perform the null dithering, in which each pixel value in the scaled and cropped input image is mapped to a binary color value for a light control unit in array 130.

The act in box 148 performs operations appropriate for a gray scale or color still image, which can include any appropriate dithering technique. The act in box 150 performs operations appropriate for gray scale or color video images, which must be processed at video refresh rates of at least 24 per second, and therefore could be implemented in hardware that performs the same dithering operation on all images, such as blue noise masking. Such hardware could also perform fixed scaling and cropping.

The act in box 152 merges segments that have been handled in any of boxes 144, 146, 148, and 150, to obtain output image data defining a version of the input image appropriate for presentation on array 130. The act in box 154 then provides the output image data to display controller 124, which may include buffers for temporary storage of data defining an image.

C.3. SPARCStation Implementation

Figure 6:
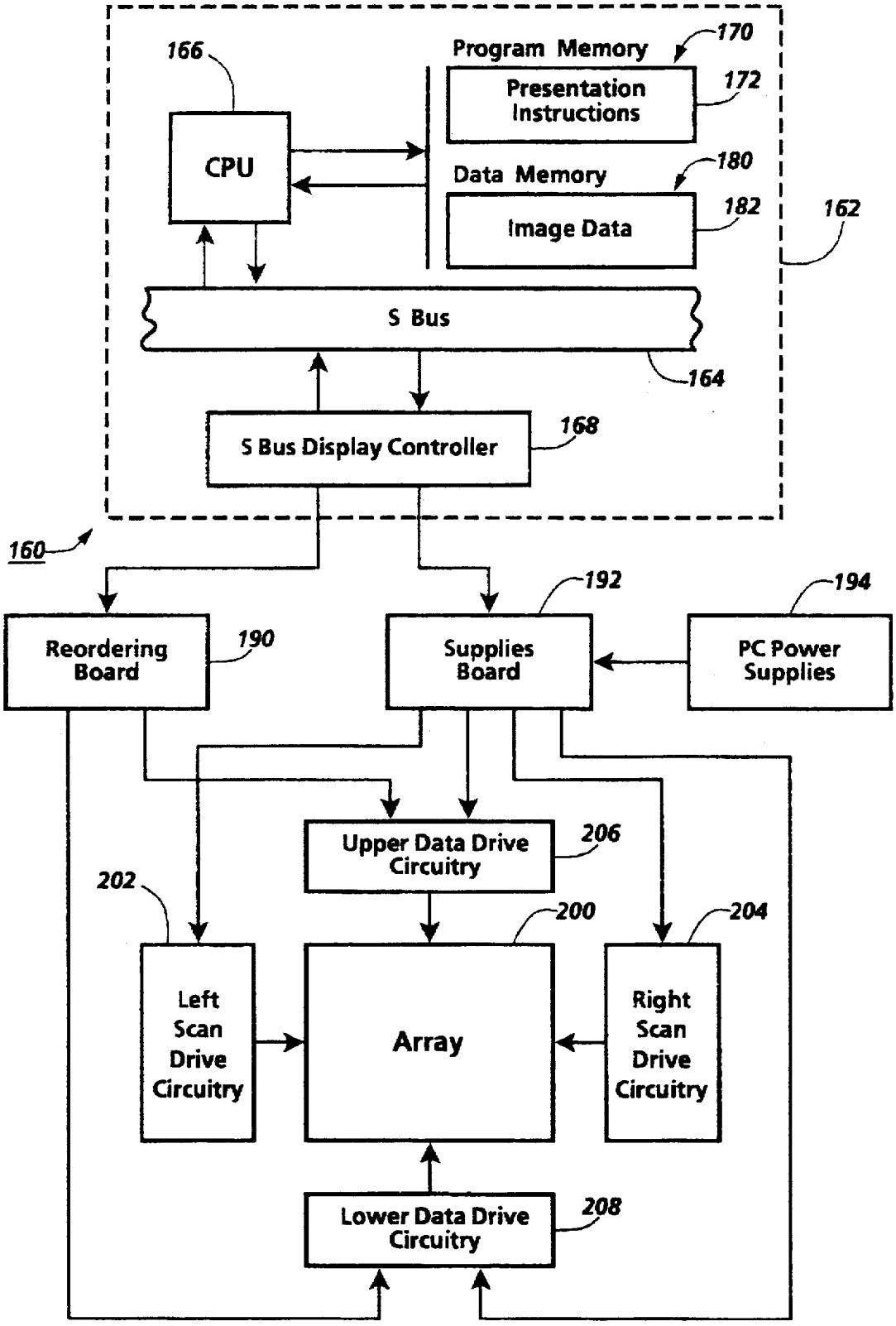
FIG. 6 is a schematic block diagram showing components of a product that can present high fidelity versions of images without ordinary acuity artifacts.

FIG. 6 shows components of a product implementing the features in FIG. 4.

Product 160 in FIG. 6 includes workstation 162, a SPARCStation from Sun Microsystems Inc., with SBus 164. Among the components connected to SBus 164 are central processing unit (CPU) 166 and SBus display controller 168. Various memory devices storing data can be accessed by CPU 166, either directly or through SBus 162; the memory devices are represented as program memory 170 storing dithering instructions 172 and data memory 180 storing image data 182. The memory devices that provide program memory 170 and data memory 180 could include various components within workstation 160 as well as various peripheral devices, accordingly to conventional techniques.

Image data 182 include data defining versions of images. CPU 166 can execute presentation instructions 172 as described below to obtain data defining versions of images that can be provided to SBus display controller 168 for presentation.

SBus display controller 168 can include conventional circuitry for receiving and providing timing and control signals on SBus 162 as well as frame buffer circuitry for receiving output image data defining an output image from SBus 162. SBus display controller 168 can also include a universal conntroller implemented as described in copending, coassigned U.S. patent application 08/135,944, entitled "AM TFT LCD Universal Controller," and in Lee, D. D., DaCosta, V. M., and Lewis, A. G., "A VLSI Controller for Active-Matrix LCDs," *IEEE International Solid-State Circuits Conference* 1994, *Digest of Technical Papers*, February 1994, pp. 156–157, both incorporated herein by reference.

SBus display controller 168 provides output image data to reordering board 190. Reordering board 190 can include conventional serial in/parallel out shift registers which operate to send the output image data on at a slower rate than received.

SBus display controller 168 also provides switch timing signals to supplies board 192, which is connected to receive appropriate voltages from DC power supplies 194. Supplies board 192 includes conventional voltage regulator circuitry which operates to provide voltages and scan line signals to array 200, switching polarity of data drive voltages to provide three polarities as indicated by the switch timing signals.

Reordering board 190 and supplies board 192 provide their output signals to drive circuitry for array 200, which can be implemented as described in copending, coassigned U.S. patent application 08/235,011, now issued as U.S. Pat. No. 5,491,347, entitled "Thin-Film Structure With Dense Array of Binary Control Units for Presenting Images" ("the Array Application") incorporated herein by reference. Array 200 can be driven by left scan drive circuitry 202, right scan drive circuitry 204, upper data drive circuitry 206, and lower data drive circuitry 208, which can be driven as described in the Array Application.

C.4. Presenting Images

Figure 7:
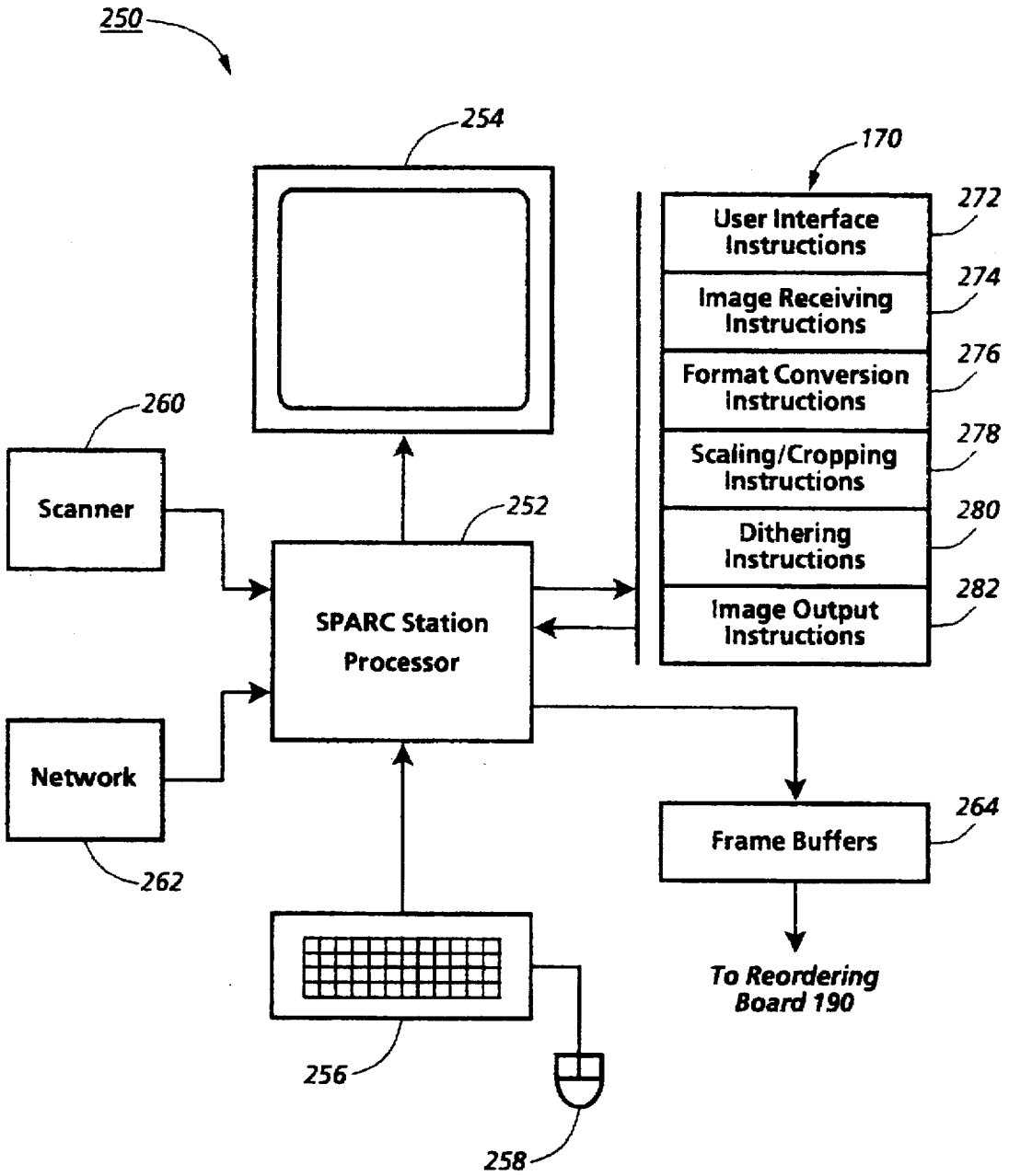
FIG. 7 is a schematic block diagram showing components of a workstation in which high fidelity versions of images can be interactively presented.
Figure 8:
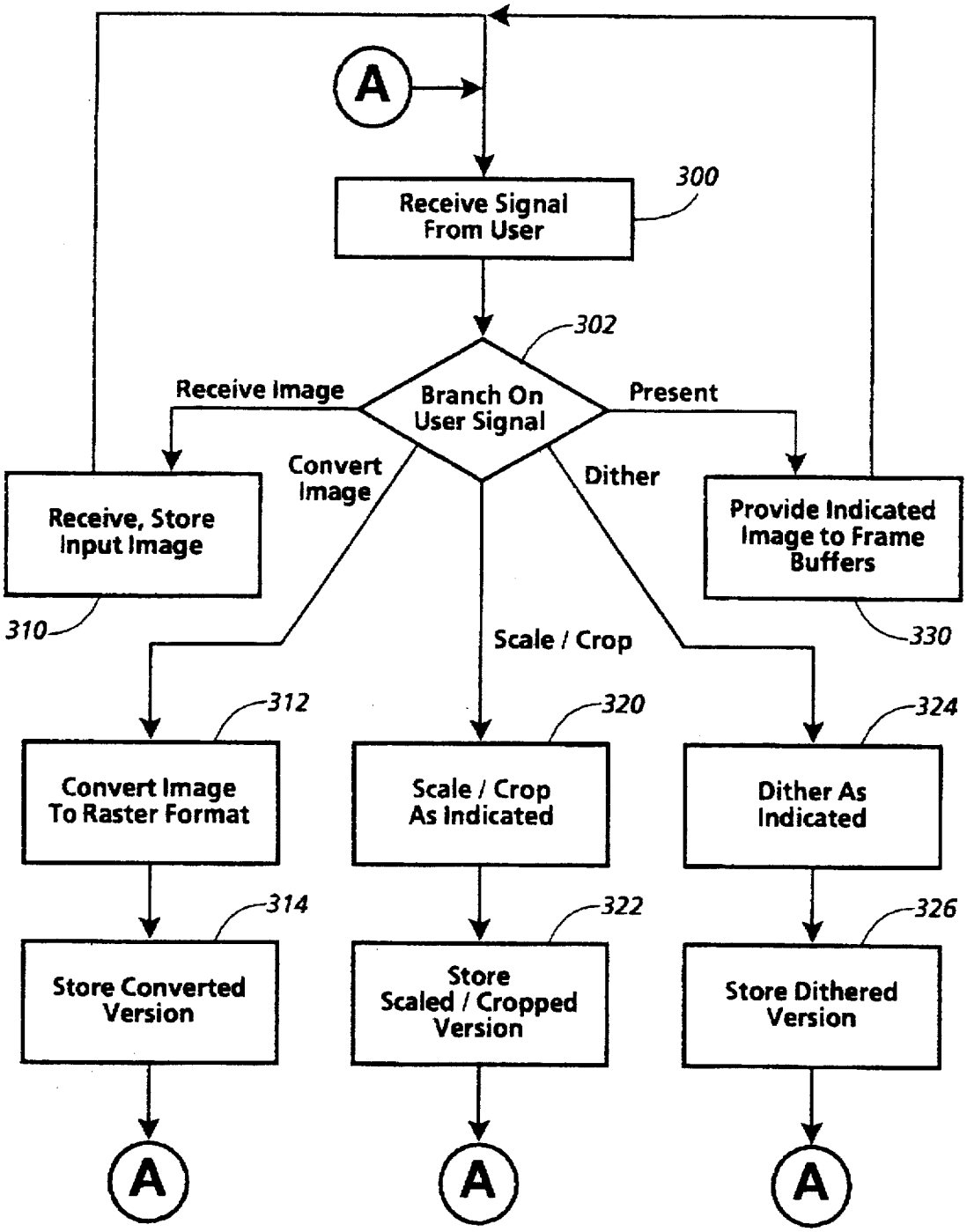
FIG. 8 is a flow chart showing acts performed in executing user interface instructions in FIG. 7.
Figure 9:
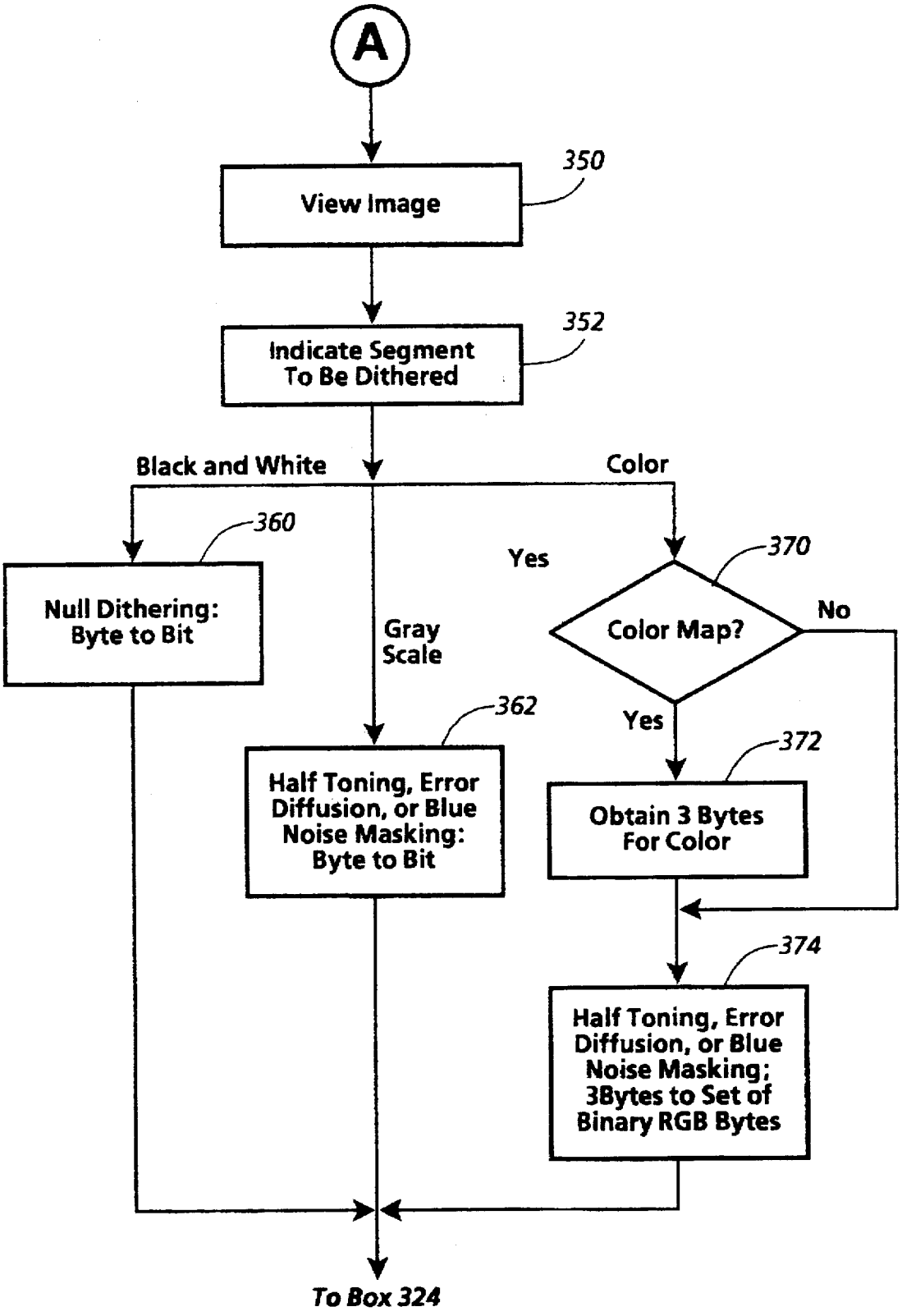
FIG. 9 is a flow chart showing how a user can provide signals requesting dithering in FIG. 8.
Figure 10:
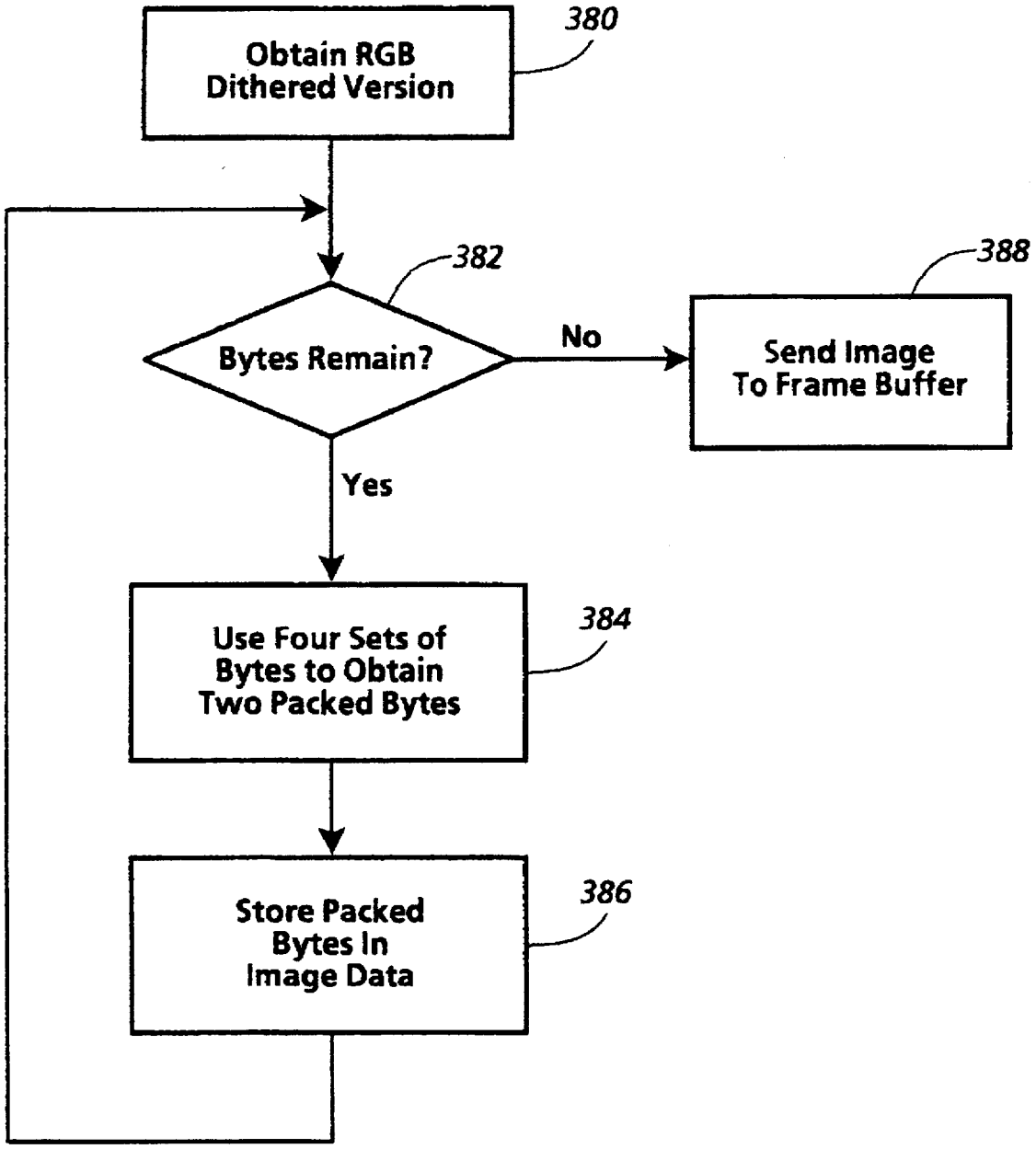
FIG. 10 is a flow chart showing how a dithered version of an image can be provided to flame buffers in FIG. 8.

Presentation instructions 172 in FIG. 6 could be implemented in a wide variety of ways to implement the features in FIG. 5. FIG. 7 illustrates components of workstation 162 that can be used in one implementation of presentation instructions 172. FIG. 8 shows acts performed in presenting an image with the components in FIG. 7. FIG. 9 shows acts in dithering in FIG. 8. FIG. 10 shows acts in providing data defining an output image for display in FIG. 8.

FIG. 7 shows workstation 250, with SPARCStation processor 252 as described above in relation to workstation 162 in FIG. 6. Processor 252 is connected to present images on workstation display 254, which can be a conventional CRT display. Processor 252 is also connected to receive user input signals from keyboard 256 and mouse 258.

Processor 252 can receive data defining input images from scanner 260 or from network 262, examples of peripheral image input devices that can be connected to workstation 250. Processor 252 can provide data defining output images to frame buffer 264, which can be part of SBus display controller 168 in FIG. 6.

As in FIG. 6, processor 252 is also connected for accessing program memory 170, which illustratively stores instructions for an interactive implementation of presentation instructions 172. When executed by processor 252, user interface instructions 272 provide a user interface through which a user can request execution of other instructions including image receiving instructions 274, format conversion instructions 276, scaling/cropping instructions 278, dithering instructions 280, and image output instructions 282, each of which can be called by user interface instructions 272.

FIG. 8 illustrates how user interface instructions 272 can be implemented. As shown, the act in box 300 in FIG. 8 begins by receiving a signal from a user, such as a sequence of keystrokes from keyboard 256 or mouse button clicks from mouse 258. In response, the act in box 302 branches depending on the signal received in box 300.

If the signal from box 300 requests an operation receiving an image, user interface instructions 272 call image receiving instructions 274, which are executed by the act in box 310. In executing image receiving instructions 274, processor 252 performs conventional operations to receive data defining an image from an image input device such as scanner 260 or network 262 and to store the received data in image data 182 in FIG. 4. The data can be received, for example, in a conventional standard format for graphic images, such as TIFF, the Raster Format of Sun Microsystems, Inc., or the Photo Shop Format of Adobe Systems Inc. Until data defining at least one image has been received and stored in box 310, the other signals shown in FIG. 5 result in no operation.

If the signal from box 300 requests an operation converting an indicated image stored in image data 182, user interface instructions 272 call format conversion instructions 276, which are executed by the acts in boxes 312 and 314. In executing format conversion instructions 276, processor 252 first performs conventional operations to convert the indicated image from another format to Sun's Raster Format, in box 312. Various format conversion tools are available, including deBabelizer from Equilibrium, Sausalito, Calif. and also including public domain software available from the Internet such as Graphic Converter. Then, processor 252 stores the converted version in image data 182, in box 314. The acts in boxes 312 and 314 are not necessary, of course, if the act in box 310 received an image in Sun's Raster Format.

If the signal from box 300 requests an operation scaling or cropping an indicated image stored in image data 182, user interface instructions 272 call scaling/cropping instructions 278, which are executed by the acts in boxes 320 and 322. Scaling or cropping may be desired, for example, where an image is defined with more or less pixel values than the number of light control units in array 200 or is shaped differently than array 200. In executing scaling/cropping instructions 276, processor 252 first performs conventional operations to perform the indicated scaling or cropping on the image, in box 320. Then, processor 252 stores the scaled/cropped version in image data 182, in box 322.

If the signal from box 300 requests an operation dithering an indicated image stored in image data 182, user interface instructions 272 call dithering instructions 280, which are executed by the acts in boxes 324 and 326. In executing dithering instructions 280, processor 252 first performs conventional operations to perform the indicated dithering on the image, in box 324. Then, processor 252 stores the dithered version in image data 182, in box 326.

If the signal from box 300 requests an operation presenting an indicated image stored in image data 182 on array 200, user interface instructions 272 call image output instructions 282, which are executed by the acts in box 330. The acts in box 330 provide the indicated image to frame buffers 264 as described in more detail below.

FIG. 9 shows an example of how a user could request dithering operations on an image, with each request indicating a segment of the image and a dithering operation to be performed on the segment. The objective of the technique in FIG. 9 is to permit the user to obtain an optimal dithering for a specific image. The acts in FIG. 9 implement the acts in boxes 300 and 302 in FIG. 8 in the case where a signal requests dithering.

In the act in box 350, the user views an image presented on workstation display 254. Based on the contents of the image, the user indicates a segment of the image to be dithered, in box 352. The user could, for example, indicate corners of the segment using mouse 258. Then, depending on the appearance of the indicated segment, the user provides signals indicating an appropriate dithering operation. Conventional software, such as Adobe Photoshop from Adobe Systems Inc., Mountain View, Calif., provides a user interface permitting a user to request operations as in FIG. 9.

If the segment includes only black and white features, such as black lines or characters on a white background, the user can request the null dithering from a byte to a bit, as in box 360. In other words, the byte that indicates the black or white color of each pixel in the data defining the segment is not changed but is replaced by a bit that is either ON or OFF. If the data is already in a format in which each bit defines black or white, the act in box 360 is not necessary.

If the segment includes gray scale, the user can request half toning, error diffusion, blue noise masking, or another appropriate dithering technique to replace each byte indicating a gray scale pixel value to a bit that is either ON or OFF, in box 362. Although all of the bits are either ON or OFF, the pattern of segments presented by array 200 can produce a perception of gray scale.

If the segment is a color segment, such as a natural image, the act in box 370 branches based on whether the values are color mapped. If so, the act in box 372 uses the values to index the color map and obtain a set of three bytes indicating RGB values for each color. With the three byte sets, the user can request half toning, error diffusion, blue noise masking, or another appropriate dithering technique to replace each set of three bytes indicating RGB values to a set of bytes indicating dithered binary RGB values for a single pattern in array 200, as shown in box 374.

Figure 11:
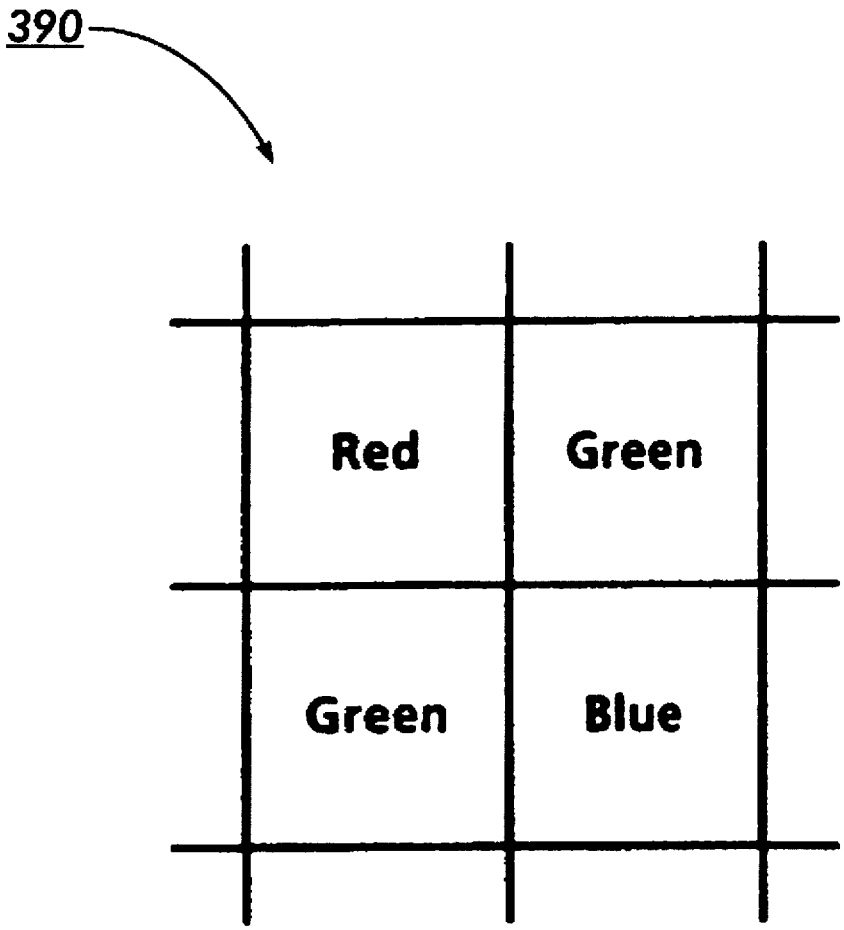
FIG. 11 is a schematic block diagram of a pattern of color filter parts that can be used in the AMLCD assembly.

As illustrated in FIG. 11, which is substantially the same as FIG. 16 of copending, coassigned U.S. patent application 08/235,011, now issued as U.S. Pat. No. 5,491,347, entitled "Thin-Film Structure With Dense Array of Binary Control Units for Presenting Images," incorporated herein by reference, each pattern in the array can include four light control units, with two greens at diagonal corners and one red and one blue. FIG. 11 shows quad-green 2×2 pattern 390 of color filter parts that has been successfully used to produce full color images. In pattern 390, two diagonally opposite parts are both green, while the other two parts are red and blue. A color filter that is a mosaic of parts with pattern 390 thus provides two green segments for each red or blue segment of an image being presented, so that the green phosphor in the backlight can be reduced, improving the color saturation of red and blue and expanding the color gamut: In each instance of pattern 390, zero, one, or two green parts can be at maximum intensity, so that pattern 390 is able to present twelve colors rather than the eight that would be available from an RGB pattern. Therefore, the set of bytes obtained in box 374 can include three binary RGB bytes if both green light control units are driven with the same signal or four binary RGB bytes if the two green light control units are driven with separate. signals.

Dithering techniques that can be used to implement each dithering requested in boxes 362 and 374 are described in Ulichney, R., *Digital Halftoning*, Cambridge, Mass.: MIT Press, 1987. Such techniques are well known in the printing art. An appropriate choice of dithering technique is very important in obtaining a high fidelity version of an image. For example, Floyd-Steinberg error diffusion techniques are especially useful for images that include natural color or gray scale with some incidental text, because they do not affect the text.

If each three-byte set indicating RGB values is mapped to three binary RGB values, as mentioned above, a very simple dithering can be tried. Each of the three bytes can be binarized by thresholding to obtain three binary values, one for the red light control unit, one for the blue light control unit, and one for each of the green light control units in a pattern. Similarly, in a mapping to four binary values, the red and blue values can be obtained by binarizing the red and blue bytes and the two green values can be obtained by thresholding the green byte into three levels, one with both green values OFF, one with one ON and one OFF, and one with both ON. If neither of these ditherings is satisfactory, Floyd-Steinberg error diffusion or another dithering technique can be tried.

If a dithering selected in box 362 or box 374 does not produce colors that are faithful to the original image, the user can select another dithering until an optimal dithering is found for the indicated segment. More generally, the technique illustrated in FIG. 9 allows the user to explore different ditherings for different segments of the image until an optimal combination of ditherings is found for the image as a whole.

FIG. 10 illustrates how data appropriate for frame buffers 264 can be obtained in box 330 in the case where a dithered binary RGB version is obtained in box 374. In other cases, the data from boxes 360 and 362 can be loaded directly into frame buffers 264 if they are converted into bit-encoded Sun Raster format, but in the dithered binary RGB case, it is necessary to convert sets of bytes into appropriately positioned sets of bits. For a working implementation, frame buffers 264 store 384 bytes per line of a 2048 line array.

The act in box 380 begins by obtaining data defining a dithered binary RGB version of an image, as from box 374. The dithered version can be retrieved from image data 182.

The act in box 382 begins an iterative loop that handles all of the non-header bytes in the dithered version. Each non-header byte can have one of two values, zero or 255, and each set of bytes indicates binary values for a pattern of four pixels on two rows. The act in box 384 begins an iteration by using four sets of bytes to obtain two packed bytes in which each bit contains information from one of the bytes in the four sets. The act in box 386 stores the packed bytes in image data 182.

When all the non-header bytes have been handled in this manner, the act in box 388 provides the resulting image to the frame buffer.

The implementation described above has been demonstrated, and observers skilled in the art of presenting images on AMLCDs expressed surprise at the high quality of the presented images. The implementation described above presents high fidelity images without noticeable ordinary acuity artifacts.

C.4. Variations

The implementation described above employs an AMLCD, but the invention could be implemented with other kinds of displays, including but not limited to plasma addressed displays such as PALCDs, field emitter displays, thin-film electroluminescent displays, and ferroelectric displays such as FLCDs, FELCDs, and AFLCDs.

The implementation described above relies on a user to select an appropriate dithering technique for segments of an image. The choice of dithering technique could be made automatically, based on segmentation techniques for obtaining segments of different types in an image. For example, the automatic technique could discriminate color segments from gray scale segments and dither the two types of segments differently. Automatic segmentation techniques that could be used are described, for example, in Bloomberg, U.S. Pat. No. 5,065,437, and Bloomberg et al., U.S. Pat. No. 5,131,049, both incorporated herein by reference.

The implementation described above relies generally on conventional dithering techniques. Various specialized dithering techniques could be developed. For example, a technique could be developed to handle image segments that include spatial frequencies that result in interference effects as a result of the sampling that occurs in presenting an image on the array; since such segments are likely to be perceived as gray, the technique could dither them as if they were uniform gray regions.

D. Application

The invention could be applied in many ways, including computer displays and televisions.

An application of the invention to print previewing and copying is described in copending, coassigned U.S. patent application 08/235,017, entitled "Presenting an Image on a Display as It Would be Presented by Another Image Output Device or on Printing Circuitry," incorporated herein by reference. The invention could be used to provide default transforms of images in print previewing.

E. Miscellaneous

The invention has been described in relation to software implementations, but the invention might be implemented with specialized hardware. For example, the invention has been described in relation to implementations in which a processor executes instructions to perform operations such as dithering. The invention might also be implemented with a specialized processor that performs such operations without executing instructions.

The invention has been described in relation to implementations using serial processing techniques. The invention might also be implemented with parallel processing techniques.

Although the invention has been described in relation to various implementations, together with modifications, variations, and extensions thereof, other implementations, modifications, variations, and extensions are within the scope of the invention. The invention is therefore not limited by the description contained herein or by the drawings, but only by the claims.

What is claimed:

1. A product comprising:

image input circuitry for providing data defining input images; the image input circuitry being able to provide data indicating M colors, where M is three or more;

display circuitry; the display circuitry including:

an array of light control units extending in first and second directions, the second direction being perpendicular to the first direction, for presenting images, the array having an area large enough to present images for direct viewing; each light control unit being structured to receive a signal and to respond to its signal by causing presentation of an image segment with one of a set of N colors, where N is less than M; the light control units having a density of greater than 100/cm in both the first and second directions so that artifacts that are visible only up to spatial frequencies of approximately 60 cycles per degree of visual angle are not noticeable in presented images when the array is directly viewed at usual viewing distances by a human with normal vision; and signal circuitry for providing signals to the light control units in response to data defining output images; and processing circuitry connected for receiving data defining input images from the image input circuitry and for providing data defining output images to the signal circuitry; the processing circuitry being operable to receive input image data from the image input circuitry; the input image data defining an input image that includes M colors;

use the input image data to obtain output image data; the output image data defining an output image that is a version of the input image; the output image data including, for each light control unit in the array, a color data item that indicates one of the light control unit's set of N colors; and provide the output image data to the signal circuitry;

the signal circuitry responding to the output image data from the processing circuitry by providing signals to the light control units for changing the light control units between a maximum intensity and a minimum intensity, so that each light control unit presents an image segment with the color indicated by the light control unit's color data item; the array of light control units together presenting the output image so that the appearance of the output image to a human with normal vision directly viewing the array at usual viewing distances is substantially identical to the appearance the input image would have if presented.

2. The product of claim 1 in which the array has an area of approximately 510 $cm^2$.

3. The product of claim 1 in which the light control units have densities in both the first and second directions of approximately 111/cm.

4. The product of claim 1 in which the array includes more than 900,000 light control units.

5. The product of claim 4 in which the array includes at least 4 million light control units.

6. The product of claim 5 in which the array includes at least 6 million light control units.

7. The product of claim 1 in which N=2 so that each light control unit can cause presentation of an image segment with one of first and second colors.

8. The product of claim 7 in which each light control unit's first color is a color of a maximum intensity the light control unit can present and each light control unit's second color is a color of a minimum intensity the light control unit can present.

9. The product of claim 8 in which the display circuitry includes a monochrome display, the first color of all of the light control units being the same.

10. The product of claim 7 in which each light control unit's signal can change the light control unit between a fully ON saturation state and a fully OFF saturation state.

11. The product of claim 10 in which each light control unit's signal can change the light control unit between its fully ON saturation state and fully OFF saturation state at least 24 times per second.

12. The product of claim 1 in which the display circuitry includes a color display; each light control unit including at least first, second, and third subunits, the first subunit being able to cause presentation of a first non-gray color, the second subunit being able to cause presentation of a second non-gray color, and the third subunit being able to cause presentation of a third non-gray color; the first, second, and third non-gray colors being different so that each light control unit can present more than three non-gray colors.

13. The product of claim 1 in which the display circuitry includes an active matrix liquid crystal display that includes the array of light control units.

14. The product of claim 1 in which the processing circuitry comprises:

memory for storing data;

a processor connected for accessing data stored in the memory; and instruction data stored in the memory; the instruction data indicating instructions the processor can execute; the processor, in executing the instructions:

using the input image data to obtain the output image data by performing dithering.

15. A method of operating a system that includes:

image input circuitry for providing data defining input images; the image input circuitry being able to provide data indicating M colors, where M is three or more;

a display; the display including:

an array of light control units extending in first and second directions, the second direction being perpendicular to the first direction, for presenting images, the array having an area large enough to present images for direct viewing; each light control unit being structured to receive a signal and to respond to its signal by causing presentation of an image segment with one of a set of N colors, where N is less than M; the light control units having a density of greater than 100/cm in both the first and second directions so that artifacts that are visible only up to spatial frequencies of approximately 60 cycles per degree of visual angle are not noticeable in presented images when the array is directly viewed at usual viewing distances by a human with normal vision; and signal circuitry for providing signals to the light control units in response to data defining output images; and processing circuitry connected for receiving data defining input images from the image input circuitry and for providing data defining output images to the signal circuitry;

the method comprising:

operating the processing circuitry to receive input image data from the image input circuitry; the input image data defining an input image that includes M colors;

operating the processing circuitry to use the input image data to obtain output image data; the output image data defining an output image that is a version of the input image; the output image data including, for each light control unit in the array, a color data item that indicates one of the light control unit's set of N colors; and operating the processing circuitry to provide the output image data to the signal circuitry; the signal circuitry responding to the output image data from the processing circuitry by providing signals to the light control units for changing the light control units between a maximum intensity and a minimum intensity so that each light control unit presents an image segment with the color indicated by the light control unit's color data item; the array of light control units together presenting the output image so that the appearance of the output image to a human with normal vision directly viewing the array at usual viewing distances is substantially identical to the appearance the input image would have if presented.

16. The method of claim 15 in which the act of operating the processor to use the input image data to obtain the output image data comprises:

operating the processor to perform dithering to obtain dithered version data defining a dithered version of the input image.

17. The method of claim 16 in which the act of operating the processor to perform dithering comprises performing error diffusion.

18. The method of claim 16 in which the act of operating the processor to perform dithering comprises half toning.

19. The method of claim 16 in which the act of operating the processor to perform dithering comprises blue noise masking.

20. The method of claim 16 in which the act of operating the processor to perform dithering comprises performing temporal dithering.

21. The method of claim 20 in which act of operating the processor to perform dithering further comprises performing spatial dithering.

22. The method of claim 15 in which the display is a monochrome display so that each light control unit's set of N colors includes a first color and a second color; the input image being a monochrome image that shows a background having the first color and a feature having the second color; the input image data including input image bytes, each input image byte indicating one of first and second pixel values, the first pixel value indicating the first color and the second pixel value indicating the second color; the act of operating the processor to use the input image data to obtain the output image data comprising:

using a set of bytes to obtain a packed byte in which each bit includes information from one of the set of bytes; each bit being ON if its byte has the first value and OFF if its byte has the second value;

the act of operating the processing circuitry to provide the output image data to the signal circuitry comprising:

providing the packed byte to the signal circuitry so that each bit of the packed byte is a color data item for a light control unit; for each bit that is ON, the signal circuitry providing a signal so that its light control unit presents the first color; for each bit that is OFF, the signal circuitry providing a signal so that its light control unit presents the second color.

23. The method of claim 22 in which each light control unit's first color is a color of a maximum intensity the light control unit can present and each light control unit's second color is a color of a minimum intensity the light control unit can present.

24. The method of claim 20 in which the feature is a dark line on a light background; the second set of light control units forming a line one light control unit wide.

25. The method of claim 26 in which the feature is text that includes characters in different fonts.

26. A product comprising:

image input circuitry for providing data defining input images; the image input circuitry being able to provide data indicating M colors, where M is three or more;

an active matrix liquid crystal display; the active matrix liquid crystal display including:

an array of light control units for presenting images, the array having an area of at least approximately 510

$cm^2$ and being large enough to present images for direct viewing; each light control unit being structured to receive a signal and to respond to its signal by causing presentation of an image segment with one of first and second colors, each light control unit's first color being a color of a maximum intensity the light control unit can present and each light control unit's second color being a color of a minimum intensity the light control unit can present; the array extending in first and second directions, the second direction being perpendicular to the first direction; the light control units having densities greater than 100/cm in both of the first and second directions and being sufficiently dense that artifacts that are visible only up to spatial frequencies of approximately 60 cycles per degree of visual angle are not noticeable in presented images when the array is directly viewed at usual viewing distances by a human with normal vision; and signal circuitry for providing signals to the light control units in response to data defining output images; the signal circuitry providing, to each light control unit, a signal that can change the light control unit between a fully ON saturation state and a fully OFF saturation state; and processing circuitry connected for receiving data defining input images from the image input circuitry and for providing data defining output images to the signal circuitry; the processing circuitry being operable to:

receive input image data from the image input circuitry; the input image data defining an input image that includes M colors;

use the input image data to obtain output image data; the output image data defining an output image that is a version of the input image; the output image data including, for each light control unit in the array, a color data item that indicates one of the light control unit's first and second colors; and provide the output image data to the signal circuitry;

the signal circuitry responding to the output image data from the processing circuitry by providing signals to the light control units so that each light control unit presents an image segment with the color indicated by the light control unit's color data item; the array of light control units together presenting the output image so that the appearance of the output image to a human with normal vision directly viewing the array at usual viewing distances is substantially identical to the appearance the input image would have if presented.

27. A method of operating a system that includes:

image input circuitry for providing data defining input images; the image input circuitry being able to provide data indicating M colors, where M is three or more;

a display; the display including:

an array of light control units extending in first and second directions, the second direction being perpendicular to the first direction, for presenting images, the array having an area large enough to present images for direct viewing; each light control unit being structured to receive a signal and to respond to its signal by causing presentation of an image segment with one of a set of N colors, where N is less than M; the light control units having a density of greater than 100/cm in both the first and second directions so that artifacts that are visible only up to spatial frequencies of approximately 60 cycles per degree of visual angle are not noticeable in presented images when the array is directly viewed at usual viewing distances by a human with normal vision; and signal circuitry for providing signals to the light control units in response to data defining output images; and processing circuitry connected for receiving data defining input images from the image input circuitry and for providing data defining output images to the signal circuitry;

the method comprising:

operating the processing circuitry to receive input image data from the image input circuitry; the input image data defining an input image that includes M colors;

operating the processing circuitry to use the input image data to obtain output image data; the output image data defining an output image that is a version of the input image; the output image data including, for each light control unit in the array, a color data item that indicates one of the light control unit's set of N colors; the act of operating the processing circuitry to use the input image data to obtain output image data comprising:

obtaining spatial dither data indicating one of a set of two or more spatial dithering operations; and performing the spatial dithering operation indicated by the spatial dither data; and operating the processing circuitry to provide the output image data to the signal circuitry; the signal circuitry responding to the output image data from the processing circuitry by providing signals to the light control units for changing the light control between a maximum intensity and a minimum intensity so that each light control unit presents an image segment with the color indicated by the light control unit's color data item; the array of light control units together presenting the output image so that the appearance of the output image to a human with normal vision directly viewing the array at usual viewing distances is substantially identical to the appearance the input image would have if presented.

28. The method of claim 27 in which the system further includes user input circuitry for receiving user input signals from a user; the act of obtaining spatial dither data comprising:

receiving a user input signal indicating one of the set of two or more spatial dithering operations; and using the user input signal to obtain the spatial dither data.

29. A method of operating a system that includes:

image input circuitry for providing data defining input images; the image input circuitry being able to provide data indicating M colors, where M is three or more;

a display; the display including:

an array of light control units extending in first and second directions, the second direction being perpendicular to the first direction, for presenting images, the array having an area large enough to present images for direct viewing; each light control unit being structured to receive a signal and to respond to its signal by causing presentation of an image segment with one of a set of N colors, where N is less than M; the light control units having a density of greater than 100/cm in both the first and second directions so that artifacts that are visible only up to spatial frequencies of approximately 60 cycles per degree of visual angle are not noticeable in presented images when the array is directly viewed at usual viewing distances by a human with normal vision; each light control unit being able to change from causing presentation of one of its set of N colors to causing presentation of another of its set of N colors at least 24 times per second; and signal circuitry for providing signals to the light control units in response to data defining output images; and processing circuitry connected for receiving data defining input images from the image input circuitry and for providing data defining output images to the signal circuitry;

the method comprising a series of iterations, each iteration comprising:

operating the processing circuitry to receive input image data for the iteration from the image input circuitry; each iteration's input image data defining an input image for the iteration, the input image including M colors;

operating the processing circuitry to use the iteration's input image data to obtain output image data for the iteration; each iteration's output image data defining an output image for the iteration; each iteration's output image being a version of the iteration's input image; each iteration's output image data including, for each light control unit in the array, a color data item that indicates one of the light control unit's set of N colors; and operating the processing circuitry to provide the iteration's output image data to the signal circuitry; the signal circuitry responding to the iteration's output image data by providing signals to the light control units for changing the light control units between a maximum intensity and a minimum intensity so that each light control unit presents an image segment with the color indicated by the light control unit's color data item; the array of light control units together presenting the iteration's output image so that the appearance of the iteration's output image to a human with normal vision directly viewing the array at usual viewing distances is substantially identical to the appearance the iteration's input image would have if presented;

the method providing the output image data of the series of iteration's at a rate of at least 24 per second.

30. A product comprising:

image input circuitry for providing data defining input images; the image input circuitry being able to provide data indicating M colors, where M is three or more;

display circuitry; the display circuitry including:

an array of light control units for presenting images, the array having an area of at least approximately 510 $cm^2$ and being large enough to present images for direct viewing; each light control unit being structured to receive a signal and to respond to its signal by causing presentation of an image segment with one of a set of N colors, where N is less than M; the light control units having a density within the array greater than 100/cm and being sufficiently dense that artifacts that are visible only up to spatial frequencies of approximately 60 cycles per degree of visual angle are not noticeable in presented images when the array is directly viewed at usual viewing distances by a human with normal vision; and signal circuitry for providing signals to the light control units in response to data defining output images; and processing circuitry connected for receiving data defining input images from the image input circuitry and for providing data defining output images to the signal circuitry; the processing circuitry being operable to:

receive input image data from the image input circuitry; the input image data defining an input image that includes M colors;

use the input image data to obtain output image data; the output image data defining an output image that is a version of the input image; the output image data including, for each light control unit in the array, a color data item that indicates one of the light control unit's set of N colors; and provide the output image data to the signal circuitry;

the signal circuitry responding to the output image data from the processing circuitry by providing signals to the light control units for changing the light control units between a maximum intensity and a minimum intensity so that each light control unit presents an image segment with the color indicated by the light control unit's color data item; the array of light control units together presenting the output image so that the appearance of the output image to a human with normal vision directly viewing the array at usual viewing distances is substantially identical to the appearance the input image would have if presented.

31. A product comprising:

image input circuitry for providing data defining input images; the image input circuitry being able to provide data indicating M colors, where M is three or more;

display circuitry; the display circuitry including:

an array of light control units extending in first and second directions, the second direction being perpendicular to the first direction, for presenting images, the array having an area large enough to present images for direct viewing; each light control unit being structured to receive a signal and to respond to its signal by causing presentation of an image segment with one of a set of N colors, where N is less than M; the light control units having a density of greater than 100/cm in both the first and second directions such that boundaries between scan lines, jagged edges, and other artifacts that indicate a boundary between segments presented by different light control units and that are visible only up to spatial frequencies of approximately 60 cycles per degree of visual angle are not noticeable in presented images when the array is directly viewed at usual viewing distances by a human with normal vision; and signal circuitry for providing signals to the light control units in response to data defining output images; and processing circuitry connected for receiving data defining input images from the image input circuitry and for providing data defining output images to the signal circuitry; the processing circuitry being operable to:

receive input image data from the image input circuitry; the input image data defining an input image that includes M colors;

use the input image data to obtain output image data; the output image data defining an output image that is a version of the input image; the output image data including, for each light control unit in the array, a color data item that indicates one of the light control unit's set of N colors; and provide the output image data to the signal circuitry;

the signal circuitry responding to the output image data from the processing circuitry by providing signals to the light control units for changing the light control units between a maximum intensity and a minimum intensity so that each light control unit presents an image segment with the color indicated by the light control unit's color data item; the array of light control units together presenting the output image so that the appearance of the output image to a human with normal vision directly viewing the array at usual viewing distances is substantially identical to the appearance the input image would have if presented.

32. A method of operating a system that includes:

image input circuitry for providing data defining input images; the image input circuitry being able to provide data indicating M colors, where M is three or more;

a display; the display including:

an array of light control units extending in first and second directions, the second direction being perpendicular to the first direction, for presenting images, the array having an area large enough to present images for direct viewing; each light control unit being structured to receive a signal and to respond to its signal by causing presentation of an image segment with one of a set of N colors, where N is less than M; the light control units having a density of greater than 100/cm in both the first and second directions so that artifacts that are visible only up to spatial frequencies of approximately 60 cycles per degree of visual angle are not noticeable in presented images when the array is directly viewed at usual viewing distances by a human with normal vision: and signal circuitry for providing signals to the light control units in response to data defining output images; and processing circuitry connected for receiving data defining input images from the image input circuitry and for providing data defining output images to the signal circuitry;

the method comprising:

operating the processing circuitry to receive input image data from the image input circuitry; the input image data defining an input image that includes M colors;

operating the processing circuitry to use the input image data to obtain output image data; the output image data defining an output image that is a version of the input image; the output image data including, for each light control unit in the array, a color data item that indicates one of the light control unit's set of N colors; the processing circuitry, in using the input image data to obtain output image data, performing a dithering operation that includes at least one of error diffusion, half toning, and blue noise masking; and operating the processing circuitry to provide the output image data to the signal circuitry; the signal circuitry responding to the output image data from the processing circuitry by providing signals to the light control units for changing the light control units between a maximum intensity and a minimum intensity so that each light control unit presents an image segment with the color indicated by the light control unit's color data item; the appearance of the output image to a human with normal vision directly viewing the array at usual viewing distances is substantially identical to the appearance the input image would have if presented because of the combination of the dithering operation and the density of the light control units.

* * * * *